US008761650B2

(12) United States Patent
Takagi et al.

(10) Patent No.: US 8,761,650 B2
(45) Date of Patent: Jun. 24, 2014

(54) FIXING DEVICE AND IMAGE FORMING APPARATUS

(75) Inventors: Hiromasa Takagi, Tokyo (JP); Masaaki Yoshikawa, Tokyo (JP); Kenji Ishii, Kanagawa (JP); Hiroshi Yoshinaga, Chiba (JP); Yuji Arai, Kanagawa (JP); Naoki Iwaya, Tokyo (JP); Tetsuo Tokuda, Kanagawa (JP); Yoshiki Yamaguchi, Kanagawa (JP); Takahiro Imada, Kanagawa (JP); Ippei Fujimoto, Kanagawa (JP); Takuya Seshita, Kanagawa (JP); Yutaka Ikebuchi, Kanagawa (JP); Arinobu Yoshiura, Kanagawa (JP); Toshihiko Shimokawa, Kanagawa (JP); Hajime Gotoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 126 days.

(21) Appl. No.: 13/291,678

(22) Filed: Nov. 8, 2011

(65) Prior Publication Data

US 2012/0121303 A1 May 17, 2012

(30) Foreign Application Priority Data

Nov. 12, 2010 (JP) ..... 2010-253988
Dec. 28, 2010 (JP) ..... 2010-293174

(51) Int. Cl.
*G03G 15/20* (2006.01)

(52) U.S. Cl.
CPC ..... *G03G 15/2053* (2013.01)
USPC ..... 399/329

(58) Field of Classification Search
USPC ..... 399/329
See application file for complete search history.

(56) References Cited

U.S. PATENT DOCUMENTS

| | | | |
|---|---|---|---|
| 5,525,775 | A | 6/1996 | Setoriyama et al. |
| 5,742,878 | A | 4/1998 | Kuroda |
| 6,055,390 | A | 4/2000 | Kurotaka et al. |
| 7,885,569 | B2 | 2/2011 | Kishi et al. |
| 7,957,663 | B2 | 6/2011 | Kishi et al. |
| 2005/0185996 | A1 | 8/2005 | Oishi et al. |
| 2007/0292175 | A1 | 12/2007 | Shinshi |

(Continued)

FOREIGN PATENT DOCUMENTS

| | | |
|---|---|---|
| JP | 4-44075 | 2/1992 |
| JP | 8-292903 | 11/1996 |

(Continued)

OTHER PUBLICATIONS

Machine translation of JP 2010-026415.*

*Primary Examiner* — Walter L Lindsay, Jr.
*Assistant Examiner* — Barnabas Fekete
(74) *Attorney, Agent, or Firm* — Oblon, Spivak, McClelland, Maier & Neustadt, L.L.P.

(57) ABSTRACT

A fixing device includes a rotatable fixing member in a form of an endless belt; a pressing member pressing the fixing member; a contacting member in contact with the pressing member; a holding member holding the contacting member in a pressing direction of the pressing member; a heating unit heating the fixing member; and shape maintaining units maintaining a shape of the fixing member. Further, the heating unit is disposed on an upstream side of a horizontal line passing through the center of the pressing member and the holding member is disposed on a downstream side of a horizontal line passing through the arc axis of the shape maintaining units.

18 Claims, 12 Drawing Sheets

(56) References Cited

U.S. PATENT DOCUMENTS

| | | | | |
|---|---|---|---|---|
| 2008/0069611 | A1 | 3/2008 | Obata et al. | |
| 2008/0175633 | A1 | 7/2008 | Shinshi | |
| 2008/0298862 | A1 | 12/2008 | Shinshi | |
| 2010/0086324 | A1 * | 4/2010 | Smith | 399/329 |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |
| 2010/0303521 | A1 | 12/2010 | Ogawa et al. | |
| 2011/0026988 | A1 | 2/2011 | Yoshikawa et al. | |
| 2011/0044706 | A1 | 2/2011 | Iwaya et al. | |
| 2011/0044734 | A1 | 2/2011 | Shimokawa et al. | |
| 2011/0052237 | A1 | 3/2011 | Yoshikawa et al. | |
| 2011/0052245 | A1 | 3/2011 | Shinshi et al. | |
| 2011/0052277 | A1 | 3/2011 | Ueno et al. | |
| 2011/0052282 | A1 | 3/2011 | Shinshi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |
| 2011/0064437 | A1 | 3/2011 | Yamashina et al. | |
| 2011/0064443 | A1 | 3/2011 | Iwaya et al. | |
| 2011/0064451 | A1 | 3/2011 | Yamaguchi et al. | |
| 2011/0064490 | A1 | 3/2011 | Imada et al. | |
| 2011/0064502 | A1 | 3/2011 | Hase et al. | |
| 2011/0076071 | A1 | 3/2011 | Yamaguchi et al. | |
| 2011/0085832 | A1 | 4/2011 | Hasegawa et al. | |
| 2011/0116848 | A1 | 5/2011 | Yamaguchi et al. | |
| 2011/0129268 | A1 | 6/2011 | Ishii et al. | |
| 2011/0150518 | A1 | 6/2011 | Hase et al. | |
| 2011/0170917 | A1 | 7/2011 | Yoshikawa et al. | |
| 2011/0176822 | A1 | 7/2011 | Ishii et al. | |
| 2011/0182634 | A1 | 7/2011 | Ishigaya et al. | |
| 2011/0182638 | A1 | 7/2011 | Ishii et al. | |
| 2011/0194869 | A1 | 8/2011 | Yoshinaga et al. | |
| 2011/0194870 | A1 | 8/2011 | Hase et al. | |
| 2011/0200368 | A1 | 8/2011 | Yamaguchi et al. | |
| 2011/0200370 | A1 | 8/2011 | Ikebuchi et al. | |
| 2011/0206427 | A1 | 8/2011 | Iwaya et al. | |
| 2011/0211876 | A1 | 9/2011 | Iwaya et al. | |
| 2011/0217056 | A1 | 9/2011 | Yoshinaga et al. | |
| 2011/0217057 | A1 | 9/2011 | Yoshinaga et al. | |
| 2011/0217093 | A1 | 9/2011 | Tokuda et al. | |
| 2011/0217095 | A1 | 9/2011 | Ishii et al. | |
| 2011/0222875 | A1 | 9/2011 | Imada et al. | |
| 2011/0222888 | A1 | 9/2011 | Ikebuchi et al. | |
| 2011/0222926 | A1 | 9/2011 | Ueno et al. | |
| 2011/0222929 | A1 | 9/2011 | Fujimoto et al. | |
| 2011/0222930 | A1 | 9/2011 | Fujimoto et al. | |
| 2011/0222931 | A1 | 9/2011 | Shinshi et al. | |
| 2011/0229178 | A1 | 9/2011 | Ogawa et al. | |
| 2011/0229181 | A1 | 9/2011 | Iwaya et al. | |
| 2011/0229200 | A1 | 9/2011 | Yamaguchi et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0229228 | A1 | 9/2011 | Yoshikawa et al. | |
| 2012/0051774 | A1 | 3/2012 | Ikebuchi et al. | |
| 2012/0114345 | A1 | 5/2012 | Fujimoto et al. | |
| 2012/0121304 | A1 | 5/2012 | Tokuda et al. | |
| 2012/0121305 | A1 | 5/2012 | Yoshikawa et al. | |

FOREIGN PATENT DOCUMENTS

| | | |
|---|---|---|
| JP | 10-213984 | 8/1998 |
| JP | 11-2982 | 1/1999 |
| JP | 3155066 | 2/2001 |
| JP | 2003-43854 | 2/2003 |
| JP | 2004-21081 | 1/2004 |
| JP | 2004-258484 | 9/2004 |
| JP | 2005-181464 | 7/2005 |
| JP | 2005-275371 | 10/2005 |
| JP | 2006-78578 | 3/2006 |
| JP | 2007-334205 | 12/2007 |
| JP | 2008-76637 | 4/2008 |
| JP | 2008-158482 | 7/2008 |
| JP | 2009-3410 | 1/2009 |
| JP | 2010-26415 | 2/2010 |
| JP | 2010-96782 | 4/2010 |

* cited by examiner

FIXING DEVICE AND IMAGE FORMING APPARATUS

CROSS-REFERENCE TO RELATED APPLICATIONS

The present application claims priority under 35 U.S.C §119 based on Japanese Patent Application Nos. 2010-253988 filed Nov. 12, 2010 and 2010-293174 filed Dec. 28, 2010 the entire contents of which are hereby incorporated herein by reference.

BACKGROUND OF THE INVENTION

1. Field of the Invention

The present invention generally relates to a fixing device including an endless belt as a fixing member, and an image forming apparatus such as a facsimile machine, a printer, a copier, a multi-function peripheral and the like including the fixing device and employing an electrophotographic scheme or an electrostatic recording scheme.

2. Description of the Related Art

Conventionally, various image forming apparatuses including a copier, a printer and the like and employing the electrophotographic scheme have been developed and disclosed. In typical image forming processes of the image forming apparatuses, a latent image is formed on a surface of a photosensitive drum as an image carrier; the latent image on the photosensitive drum is developed to be visualized by using toner as developer; the developed image is transferred onto a recording paper (which is also called a sheet or a recording medium) by a transfer device, so that the image (toner image) is carried onto the recording sheet; and the toner image on the recording paper is fixed by being pressed and heated by a fixing device.

In the fixing device, a fixing member is in contact with a pressing member so that a nip section is formed. The fixing member may include a pair of rollers facing each other, or a belt, or a combination thereof. The recording paper is sandwiched in the formed nip section, where heat and pressure are applied to the recording paper so that the toner image is fixed on the recording paper.

As an example of the fixing device, a fixing belt stretched by plural roller members is used as the fixing member (see, for example, Japanese Patent Application Publication No. 11-2982 (Patent Document 1)). The fixing device using such a fixing belt typically include the fixing belt (endless belt) as the fixing member, plural roller members for stretching and supporting the fixing belt, a heater included in one of the roller members, and a pressing roller (as a pressing member). The heater is used to heat the fixing belt via the roller member. The toner image on a recording medium fed to the nip section formed between the fixing belt and the pressing roller is fixed to the recording medium by the heat and the pressure applied at the nip section (belt fixing method).

Further, as another example of the fixing device used in the image forming apparatus, the fixing device includes a fixing member slidably connected with an inner surface of a rotating fixing member. For example, Japanese Patent Application Publication No. 4-44075 (Patent Document 2) discloses the fixing device employing a film heating method, in which a fixing nip section is formed by sandwiching a heat resistant film (fixing film) between a ceramic heater as a heating element and a pressing roller as a pressing member. A recording material (recording medium) on which an unfixed toner image to be fixed is carried is introduced between the film and the pressing roller and is fed along the film while being sandwiched. By doing this, in the nip section, the heat from the ceramic heater is conducted to the recording material via the film. As a result, the unfixed toner image is heat-press fixed to the surface of the recording material due to the heat and pressure applied to the nip section. The fixing device employing the film heating method may serve as an on-demand type device by using the ceramic heater and a member having a lower heat capacity as the film. Further, in the fixing device employing the film heating method, power may be supplied to the ceramic heater to heat and maintain the ceramic heater at a predetermined temperature only when the image forming operation of the image forming apparatus is to be executed. Therefore, the fixing device employing the film heating method has advantages to reduce the wait time period from when the power of the image forming apparatus is turned on to when the image forming apparatus is ready to perform image forming (quick start capability) and to remarkably reduce the energy consumption in a stand-by mode (lower energy consumption).

Further, Japanese Patent Application Publication Nos. 8-292903 (Patent Document 3) and 10-213984 (Patent Document 4) disclose fixing devices employing a pressing belt method, which includes a rotatable heat fixing roller having an elastically deformed surface, an endless belt (pressing belt) which is movable while being in contact with the heat fixing roller, and a non-rotatable pressing pad disposed inside the endless belt. The pressing pad presses the endless belt to the heat fixing roller to form a belt nip section where a recording paper is fed between the endless belt and the heat fixing roller, and elastically deforms the surface of the heat fixing roller. According to this fixing method, the belt is used as the pressing member. Therefore, a contact area between the sheet and the roller can be enlarged. As a result, the heat conductivity efficiency can be remarkably improved, the energy consumption can be reduced, and size of the device can also be reduced.

In the fixing device of Patent Document 1, it may be possible to reduce the operating time when compared with the apparatus using the fixing roller. However, there may be limitations to reduce a warm-up time (which is a time period necessary to increase the temperature to perform printing) and a first printing time (which is a time period from when print request is received to when the apparatus is ready to start printing and actually discharge the printed sheet).

In contrast, in the fixing device of Patent Document 2, due to use of the member having a lower heat capacity, the warm-up time and the fast printing time may be reduced and the size of the device may also be reduce. However, in the fixing device of Patent Document 2, there may be problems in durability and in temperature stability of the belt. Namely, the abrasion resistance in sliding between the ceramic heater as a heat source and the inside surface of the belt may not be sufficient, and continuous abrasion between the ceramic heater and the belt may wear (damage) the surface and may increase the friction resistance between the ceramic heater and the belt, which may cause unstable movement of the belt. Otherwise, for example, the driving torque of the fixing device may increase. As a result, the transfer sheet on which an image is to be formed may slip, which may cause misalignment of the image. Further, the stress applied to the driving gear may increase, which may damage the gear (Problem 1).

Further, in the fixing device employing the film heating method, the belt is locally heated at the nip section. Because of this feature, the temperature of the belt just before the belt enters into the nip section become minimum. Therefore, (especially when the belt is rotated fast,) a fixing failure (e.g., insufficient fixing) is likely to occur (Problem 2).

On the other hand, in Patent Document 3, as a low friction sheet (sheet shaped sliding member), a glass fiber sheet in which PTFE (polytetrafluoroethylene) is impregnated (i.e., PTFE impregnated glass cloth) is provided on the surface of the pressing pad to improve the problem in the slidability between the inside surface of the belt and the fixing member. However, in such a fixing device employing the pressing belt method, the heat capacity of the fixing roller is high. Therefore, it may take more time to increase the temperature. Namely, the warm-up time may become long (Problem 3).

In regard to the Problems 1 to 3, Japanese Patent Application Publication Nos. 2007-334205 (Patent Document 5) and 2008-158482 (Patent Document 6) disclose fixing devices that enable heating the entire fixing belt by providing a facing member (metal heat conductor) having substantially a pipe shape disposed on the inner periphery side of the endless fixing belt and a resistor heater such as a ceramic heater disposed on the inner periphery side of the facing member and heating the facing member. By having this configuration, the warm-up time and the first printing time may be reduced, and further heat shortage in fast rotating may be resolved.

In the fixing devices described in Patent Documents 5 and 6, the metal heat conductor disposed so as to face the inner periphery of the fixing member has a substantially circular shape. Due to the shape, when the heat source is disposed inside the metal heat conductor, the circumferential length of the metal heat conductor may have to be increased. As a result, not only the size of the fixing device but also the heat capacity of the entire fixing device may be increased, thereby increasing the energy consumption. To reduce the higher energy consumption, a sheet heating element having higher heat efficiency than that of a halogen heater may be used. However, to that end, it may become necessary to further provide a pressing mechanism inside the sheet heating element to press the sheet heating element so that the sheet heating element can be in close contact with the fixing member or the metal heat conductor with a uniform surface pressure. Namely, even when the sheet heating element is used instead of using the halogen heater, the pressing mechanism including the sheet heating element may be required to be contained inside the fixing member or the metal heat conductor. As a result, similar to the case described above, the circumferential length of the fixing member may be increased.

SUMMARY OF THE INVENTION

The present invention is made in light of the problems, and may provide a fixing device having a smaller size and reducing the energy consumption and an image forming apparatus including the fixing device.

According to an aspect of the present invention, a fixing device includes a rotating fixing member formed of a flexible material and made in a form of an endless belt, a pressing member disposed on an outer periphery side of the fixing member and pressing the fixing member; a contacting member disposed on an inner periphery side of the fixing member and being in contact with the pressing member via the fixing member upon being pressed by the pressing member; a holding member disposed on the inner periphery side of the fixing member and holding the contacting member in a pressing direction of the pressing member; a heating unit heating the fixing member; and shape maintaining units disposed on respective ends of the fixing member and maintaining a shape of the fixing member by being in direct or indirect slide contact with an inner peripheral surface of the fixing member.

Further, when a first central axis line is a line passing through a center axis of the pressing member and extending in a direction orthogonal to a feeding direction of a recording medium passing through the fixing device on a vertical cross section of the fixing device, and a second central axis line is a line passing through an arc axis of the shape maintaining units and extending in the direction orthogonal to the feeding direction of the recording medium passing through the fixing device on the vertical cross section of the fixing device, the heating unit is disposed on an upstream side of the first central axis line in the feeding direction and the holding member is disposed on a downstream side of the second central axis line in the feeding direction.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

In the following, embodiments of the present invention are described with reference to the accompanying drawings.

First Embodiment

First, an image forming apparatus according to a first embodiment of the present invention is described with reference to FIG. 1.

Figure 1:
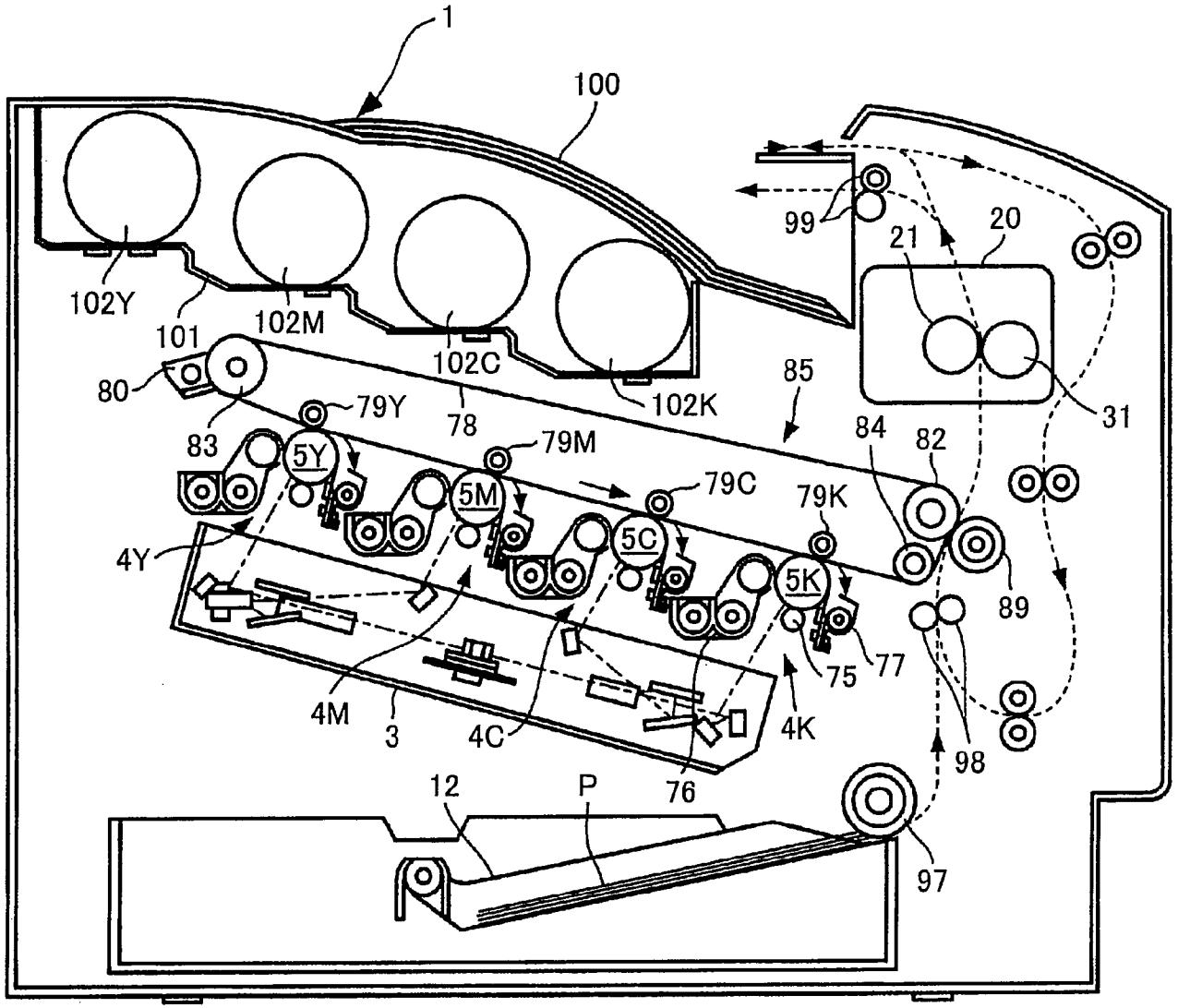
FIG. 1 is schematic drawing illustrating an entire configuration of an image forming apparatus according to a first embodiment of the present invention.

As illustrated in FIG. 1, an image forming apparatus 1 is a tandem-type color printer. A bottle container 101 disposed in the upper part of the image forming apparatus 1 includes four toner bottles 102*y*, 102M, 102C, and 102K corresponding to four colors (Yellow, Magenta, Cyan, and Black) which are detachably provided in the bottle container 101. Namely, those four tonner bottles 102*y*, 102M, 102C, and 102K can be replaced by a user.

Under the bottle container 101, there is an intermediate transfer unit 85 including an intermediate transfer belt 78. Further, there are image forming sections 4Y, 4M, 4C, and 4K corresponding to the four colors arranged (Yellow, Magenta, Cyan, and Black) which are arranged so as to face the intermediate transfer belt 78.

The image forming sections 4Y, 4M, 4C, and 4K include corresponding photosensitive drums 5Y, 5M, 5C, and 5K. Further, for each of the photosensitive drums 5Y, 5M, 5C, and 5K, there are provided a charge section 75, a development section 76, a cleaning section 77 and a neutralization section (not shown). Thereby, image forming processes (i.e., a charging process, an exposing process, a developing process, a transferring process, a cleaning process) are performed on the photosensitive drums 5Y, 5M, 5C, and 5K, so that images of the colors are formed on the corresponding photosensitive drums 5Y, 5M, 5C, and 5K.

The photosensitive drums 5Y, 5M, 5C, and 5K are driven to be rotated by driving motors (not shown) so are to rotate in the clockwise direction of FIG. 1. Further, the surfaces of the photosensitive drums 5Y, 5M, 5C, and 5K are uniformly charged at the respective positions of the charge sections 75 (the charging process). Then, the surfaces of the photosensitive drums 5Y, 5M, 5C, and 5K are moved to the positions where laser light is irradiated by an exposure section 3. At the positions, exposure scannings are performed so that latent images corresponding to the colors are formed (the exposing process).

Then, the surfaces of the photosensitive drums 5Y, 5M, 5C, and 5K are moved to the positions facing the respective development sections 76. At the positions, the latent images are developed, so that toner images of the corresponding colors are formed (the developing process). Then, the surfaces of the photosensitive drums 5Y, 5M, 5C, and 5K are moved to the positions facing the intermediate transfer belt 78 and respective primary transfer bias rollers 79Y, 79M, 79C, and 79K. At the positions, the toner images on the photosensitive drums 5Y, 5M, 5C, and 5K are transferred onto the intermediate transfer belt 78 (first transferring process). After this process, however, a small amount of toner (untransferred toner) may remain on the surfaces of the photosensitive drums 5Y, 5M, 5C, and 5K.

Then, the surfaces of the photosensitive drums 5Y, 5M, 5C, and 5K are moved to the positions facing the respective cleaning sections 77. At the positions, the untransferred toner remaining on the surfaces of the photosensitive drums 5Y, 5M, 5C, and 5K is mechanically collected by the cleaning blades of the cleaning sections 77 (the cleaning process).

Finally, the surfaces of the photosensitive drums 5Y, 5M, 5C, and 5K are moved to the positions facing the respective neutralization sections (not shown). At the positions, the residual potential on the surface of the photosensitive drums 5Y, 5M, 5C, and 5K is removed. By doing as described above, a series of image forming processes are completed.

After that, the toner images of the colors formed on the respective photosensitive drums through the developing process are superimposedly transferred onto the intermediate transfer belt 78. By doing this, the corresponding color image is formed on the intermediate transfer belt 78. The intermediate transfer unit 85 further includes the four primary transfer bias rollers 79Y, 79M, 79C, and 79K, a secondary transfer backup roller 82, a cleaning backup roller 83, a tension roller 84, and an intermediate transfer cleaning section 80. As a result, the intermediate transfer belt 78 is stretched and supported by the three rollers 82 through 84, and is driven by the roller 82 to be rotated (endlessly moved) in the arrow direction of FIG. 1.

The four primary transfer bias rollers 79Y, 79M, 79C, and 79K and the respective photosensitive drums 5Y, 5M, 5C, and 5K sandwich the intermediate transfer belt 78 to form the respective primary transfer nip sections. Further, a transfer bias having the polarity opposite to that of toner is applied to the primary transfer bias rollers 79Y, 79M, 79C, and 79K. Further, the intermediate transfer belt 78 moves in the arrow direction of FIG. 1 so as to sequentially pass through the primary transfer nip sections of the primary transfer bias rollers 79Y, 79M, 79C, and 79K. By doing this, the toner images of the colors formed on the photosensitive drums 5Y, 5M, 5C, and 5K are superimposed and primarily transferred onto the intermediate transfer belt 78.

After that, the intermediate transfer belt 78 on which the toner images of the colors are superimposed and primarily transferred are moved to the position facing a secondary transfer roller 89. At the position, the secondary transfer roller 89 and the secondary transfer backup roller 82 sandwich the intermediate transfer belt 78 to form a secondary transfer nip section. Further, the four-color toner image formed on the intermediate transfer belt 78 is transferred onto a recording medium P fed to the secondary transfer nip section. In this case, the untransferred toner that has not been transferred onto the recording medium P may remain on the intermediate transfer belt 78. Then, the intermediate transfer belt 78 is moved to the position of the intermediate transfer cleaning section 80. At the position, the untransferred toner remaining on the intermediate transfer belt 78 is collected. By doing as described above, a series of transferring processes are completed.

Herein, the recording medium P is fed from a sheet supply section 12 disposed in a lower part of the image forming apparatus 1 to the secondary transfer nip section by a sheet feeding roller 97 and a pair of resist rollers 98. More specifically, plural recording media P such as transfer sheets are stacked in the sheet supply section 12. When the sheet feeding roller 97 is driven to be rotated in the counterclockwise direction of FIG. 1, a top recording medium P is fed between the resist rollers 98.

The recording medium P fed between the resist rollers 98 temporarily stops at a roller nip position of the resist rollers 98 which are stopped rotating. When the resist rollers 98 start rotating in synchronization with the timing of the color image on the intermediate transfer belt 78, the recording medium P is fed to the secondary transfer nip section. By doing this, a desired color image is transferred onto the recording medium P.

After that, the recording medium P on which the color image is transferred in the secondary transfer nip section is fed to the position of a fixing device 20. Then, at the position, the color image transferred onto the surface is fixed to the recording medium P by the heat and pressure applied by a fixing sleeve 21 and a pressing roller 31. Then, the recording medium P is discharged outside the apparatus by a pair of discharge rollers 99. The recording media P discharged by the discharge rollers 99 are sequentially stacked on a stack section 100 as output images. By doing as described above, a series of image forming processes in the image forming apparatus is completed.

Next, details of the fixing device 20 are described with reference to FIG. 2. As described in FIG. 2, the fixing device 20 includes the fixing sleeve 21, a nip forming member 22, a holding member 23, a heater 33, a first plate 29, a second plate 41, a pressing roller 31 (as a pressing member), a temperature sensor 27, and a flange 35.

Figure 2:
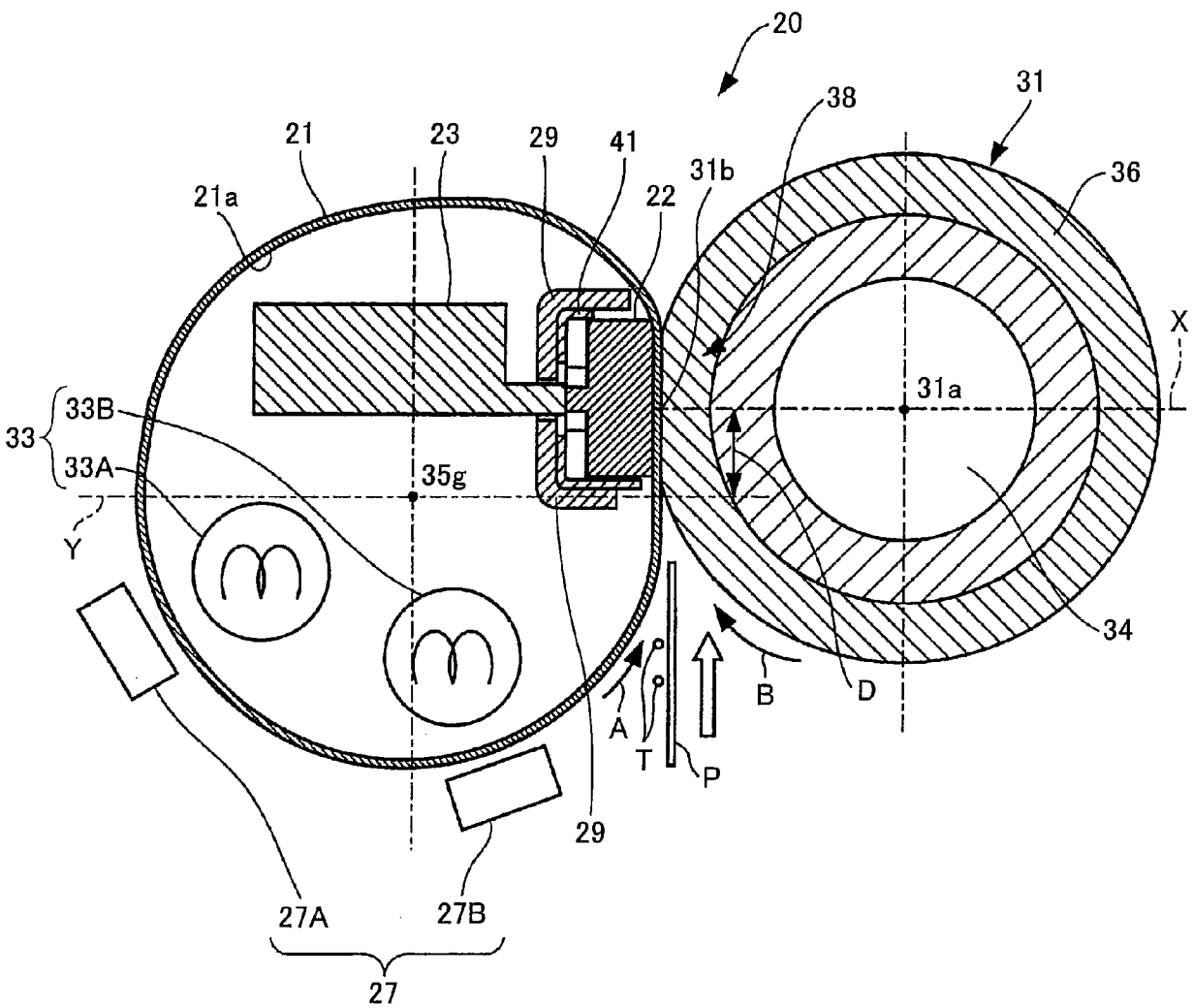
FIG. 2 is a partial cross-sectional view of a fixing device according to the first embodiment of the present invention.
Figure 3A:
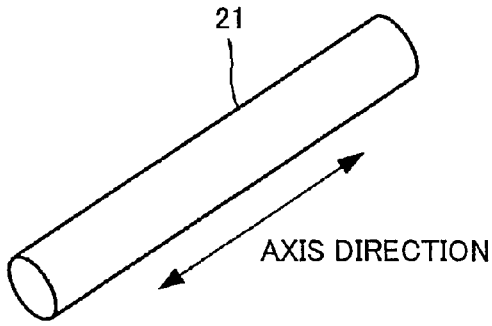
FIG. 3A is a perspective view of a fixing sleeve of the fixing device according to the first embodiment of the present invention.
Figure 3B:
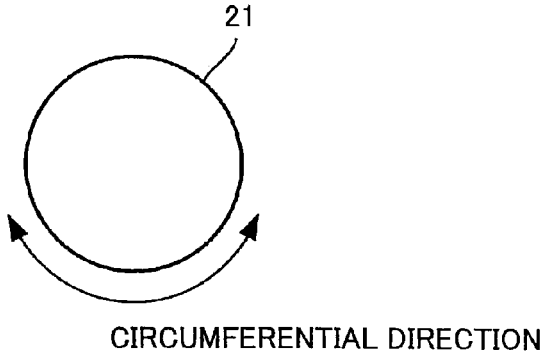
FIG. 3B is a side view of the fixing sleeve of the fixing device according to the first embodiment of the present invention.

As illustrated in FIGS. 3A and 3B, the fixing sleeve 21 is formed as a thin and flexible endless belt. Further, the fixing sleeve 21 moves in the arrow A direction of FIG. 2. The fixing sleeve 21 includes a substrate layer, an elastic layer, and a releasing layer sequentially laminated in this order from an inner peripheral surface 21*a* of the fixing sleeve 21. The inner peripheral surface 21*a* of the fixing sleeve 21 becomes a slide contact surface which is in slide contact with the nip forming member 22. Further, the fixing sleeve 21 is formed so that the thickness of the entire fixing sleeve 21 is equal to or less than 1 mm.

The substrate layer of the fixing sleeve 21 has a thickness in a range from 25 μm to 35 μm and is formed of a metal material such as nickel and stainless or a resin material such as polyimide.

The elastic layer of the fixing sleeve 21 has a thickness in a range from 100 μm to 300 μm and is formed of a rubber material such as silicone rubber, expandable silicone rubber, and fluorine-containing rubber. By having the elastic layer, it may become possible to prevent the surface of the fixing sleeve 21 from forming minute unevenness. Further, it may become possible to uniformly transfer heat to the toner image T on the recording medium P, thereby controlling the production of an orange peel (undesired) image.

The releasing layer of the fixing sleeve 21 has a thickness in a range from 10 μm to 50 μm and is formed of PFA (tetrafluoroethylene/perfluoroalkylvinylether copolymer), PTFE (polytetrafluoroethylene), polyimide, polyetherimide, PES (polyether sulphide) or the like. By having the releasing layer, it may become possible to ensure the releasability (detachability) for the toner image T.

It may be preferable that the diameter of the fixing sleeve 21 is in a range from 15 mm to 120 mm. In this embodiment, the diameter of the fixing sleeve 21 is approximately 30 mm.

Further, the fixing sleeve 21 may be referred to as a fixing member of the present invention. The fixing sleeve 21 may be a film formed of a metal material such as nickel, stainless (SUS) or the like or a resin material such as polyimide.

On the inner periphery side of the fixing sleeve 21, there are provided the nip forming member 22, the holding member 23, the heater 33, the first plate 29, and the second plate 41.

The nip forming member 22 is fixed so as to be in slide contact with the inner peripheral surface 21*a* of the fixing sleeve 21. When the nip forming member 22 is in press contact with the pressing roller 31 via the fixing sleeve 21, a fixing nip section 38 where the recording medium P is fed through is formed. To that end, the nip forming member 22 is provided on the inner periphery side of the fixing sleeve 21 so as to be in press contact with the pressing roller 31 via the fixing sleeve 21 by the pressure from the pressing roller 31 to form the fixing nip section 38.

Both of the end sections of the nip forming member 22 in the width direction are fixedly supported by the flange 35 described below of the fixing device 20. A configuration of the nip forming member 22 is described below.

As schematically illustrated in FIG. 2, as the heater 33 as a heat source, a known halogen heater is used to heat the fixing sleeve 21 by radiation heat. Further, the heater 33 includes a first heater 33A and second heaters 33B. Both of the end sections of the heaters 33A and 33B protrude through openings of the flange 35 and are fixed to the main body (e.g., side plates) of the fixing device 20.

The first heater 33A is provided so as to mainly heat the center part which is the center region in the axis direction of the fixing sleeve 21. Therefore, strong emission of the first heater 33A is present at the center region in the longitudinal direction of the fixing sleeve 21. On the other hand, the second heaters 33B are provided so as to mainly heat the respective end sections which are the end regions in the axis direction of the fixing sleeve 21. Therefore, strong emission of the second heaters 33B is present at the end regions in the longitudinal direction of the fixing sleeve 21. Further, the first and the second heaters 33A and 33B directly heat the fixing sleeve 21. Therefore, the first heater 33A and the second heaters 33B may be collectively referred to as a heating unit of the present invention.

As the heater 33, an IH (Induction Heating) heater, a resistance heater, a carbon heater or the like may be used. However, to efficiently heat the fixing sleeve 21, it is preferable to dispose the heater 33 at a position just before the fixing nip section 38 (in a lower part of FIG. 2).

The temperature sensor 27 is provided so as to face a surface of the fixing sleeve 21. As the temperature sensor 27, a known thermistor or the like may be used. The temperature sensor 27 includes a first temperature sensor 27A and second temperature sensors 27B. The first temperature sensor 27A is disposed at a position facing the center region in the longitudinal direction of the fixing sleeve 21 so as to detect the temperature of the first heater 33A. The second temperature sensors 27B are disposed at positions facing the respective end regions in the longitudinal direction of the fixing sleeve 21 so as to detect the temperatures of the second heaters 33B. The first temperature sensor 27A may be referred to as a center section temperature detecting unit of the present invention, and the second temperature sensors 27B may be referred to as an end section temperature detecting unit of the present invention.

To perform highly accurate control on the temperature of the thin fixing sleeve 21 having low heat capacity, it is highly preferable that the sensors 27A and 27B are disposed at the positions close enough to the positions where the heater 33 irradiates heat most in the longitudinal direction of the fixing sleeve 21.

As described above, the first and the second temperature sensors 27A and 27B are disposed at the positions close enough to the respective center sections and the end sections. Therefore, it may become possible to highly accurately detect the temperatures and accordingly highly accurately perform the temperature control on the fixing sleeve 21. As a result, it may become possible to improve the image quality. Further, it is preferable for the first and the second temperature sensors 27A and 27B to detect the temperatures without directly contacting the fixing sleeve 21 so as not to cause damage to the fixing sleeve 21 due to the direct slide contact. As a contactless sensor, a thermopile, a contactless thermistor and the like may be used. As a contact sensor, a contact thermistor may be used.

Further, power is supplied to the first and the second heaters 33A and 33B from a power supply section of the image forming apparatus 1, and the power is controlled by a control section (not shown) in the image forming apparatus 1. The control section acquires signals indicating the detection results of the temperatures of the surface of the fixing sleeve 21, and performs control of the heat output from the first heater 33A and the second heater 33B based on the acquired signals. Further, the control section performs control to set the temperature of the fixing sleeve 21 at a desired temperature by turning on and off the first and the second heaters 33A and 33B.

By having the structure as described above, the fixing sleeve 21 may enter into the fixing nip section 38 while the fixing sleeve 21 is especially heated by the heater 33 at the position on the upstream side of the recording medium P (the fixing nip section 38) and near the fixing nip section 38. As a result, sufficient heat may be transferred from the surface of the heated fixing sleeve 21 to the toner image T on the recording medium P.

As described above, in the fixing device 20 according to this embodiment of the present invention, the fixing sleeve 21 may be widely heated by the heater 33 along the circumferential direction focusing on the area on the upstream side of the fixing nip section 38 in the circumferential direction and close to the fixing nip section 38. Because of this feature, even when the recording medium P is fed fast, sufficient heat may be transferred to the fixing sleeve 21 and a fixing failure may be prevented. As a result, since the fixing sleeve 21 may be efficiently heated with a relatively simple configuration as described above, the warm-up time and the first printing time may be reduced and the size of the device may also be reduced.

The holding member 23 holds the nip forming member 22 that forms the fixing nip section 38. The holding member 23 is provided on the inner periphery side of the fixing sleeve 21. Since the holding member 23 holds the position of the nip forming member 22 relative to the pressing direction of the pressing roller 31, the holding member 23 may be referred to as a holding member of the present invention.

Figure 8:
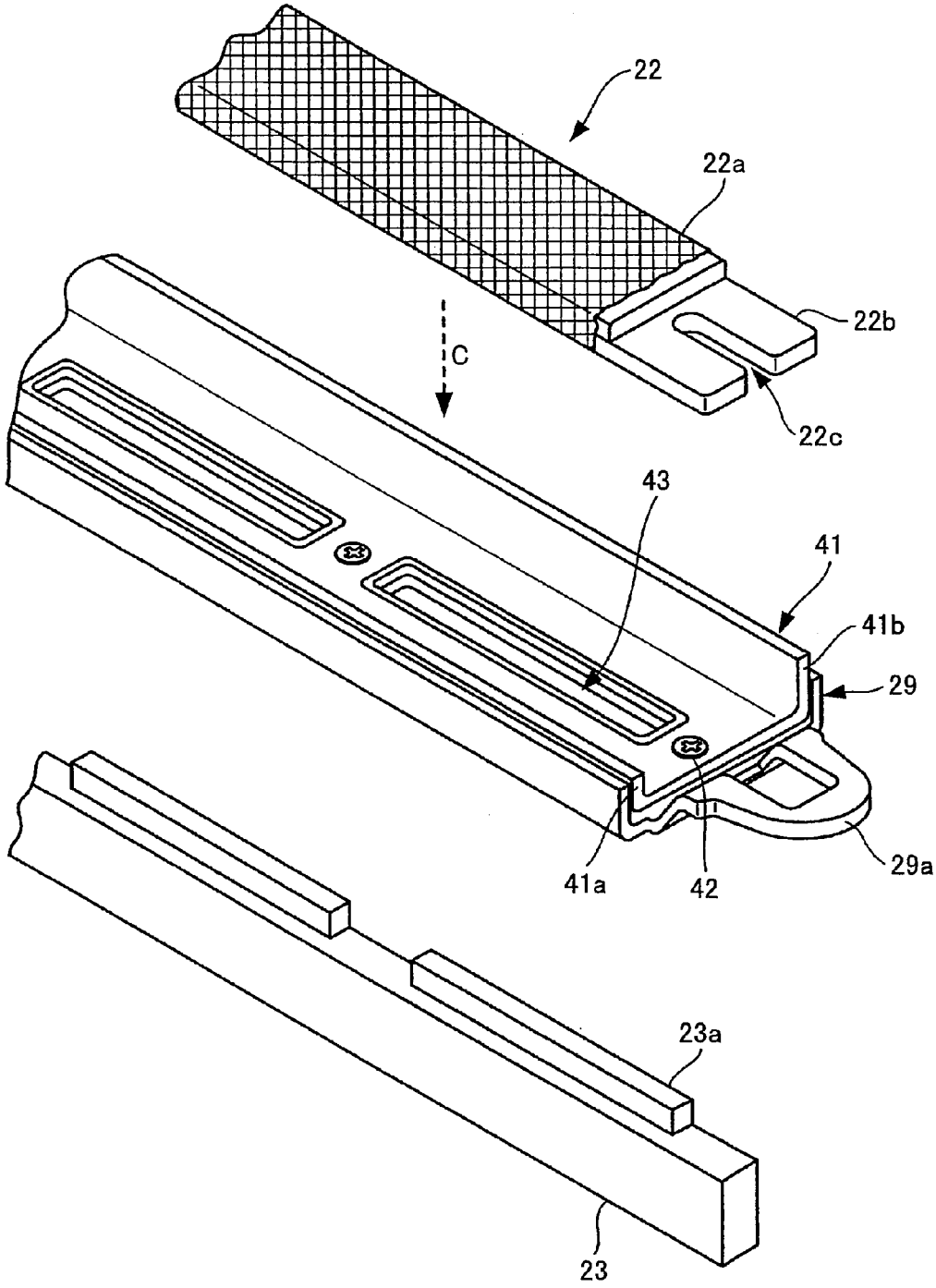
FIG. 8 is an exploded perspective view of the parts of the fixing sleeve of the fixing device according to the first embodiment of the present invention.

Further, the holding member 23 has the length substantially equal to the length of the nip forming member 22. The ends of the holding member 23 in the width direction are fixed to the main body (e.g., the side plates) via the corresponding flanges 35. The holding member 23 is formed of a metal material having higher mechanical strength such as stainless, iron or the like. By having the features, when the holding member 23 is in contact with the pressing roller 31 via the nip forming member 22 and the fixing sleeve 21, it may become possible to prevent the nip forming member 22 from being greatly deformed by the pressure applied from the pressing roller 31. As described above, the holding member 23 holds the nip forming member 22 relative to the pressing direction of the pressing roller 31. Further, as illustrated in FIG. 8, the holding member 23 includes protruding parts 23*a* that engage the nip forming member 22.

The holding member 23 may be heated by the radiation heat from the heater or the like. Therefore, adiabatic treatment or mirror treatment is performed on the surface of the holding member 23. Due to such treatment, it may become possible to prevent the holding member from being heated and reduce unnecessary energy consumption.

Referring back to FIG. 2, as a pressing rotator, the pressing roller 31 is in press contact with an outer peripheral surface of the fixing sleeve 21 so as to form the desired fixing nip section 38 between the pressing roller 31 and the fixing sleeve 21. In this embodiment, the diameter of the pressing roller 31 is approximately 30 mm. Further, the pressing roller 31 is formed by forming an elastic layer 36 on a core metal 34 having a hollow structure. The elastic layer 36 of the pressing roller 31 is formed of a material such as silicone rubber, expandable silicone rubber, and fluorine-containing rubber. The pressing roller 31 may further include a thin releasing layer formed on the surface layer of the elastic layer 36 and formed of a material including PFA, PTFE or the like. The pressing roller 31 is biased to the fixing sleeve 21 side by a spring or the like (not shown). When the elastic layer 36 (rubber layer) is deformed, the desired fixing nip section 38 having a desired width may be formed. The pressing roller 31 may be solid roller. However, when the pressing roller 31 has the hollow structure, the heat capacity may be reduced.

The pressing roller 31 is driven to be rotated in the arrow B (clockwise) direction of FIG. 2 by a driving mechanism (not shown). Further, the end sections in the width direction of the pressing roller 31 are rotatably supported by the corresponding side plates 51 (see FIG. 6) of the fixing device 20 by bearing joints (not shown). Further, the pressing roller 31 may further include a heat source such as a halogen heater inside the pressing roller 31.

When the elastic layer 36 of the pressing roller 31 is formed of a sponge-like material such as expandable silicone rubber, the pressing force to be applied to the fixing nip section 38 may be reduced. Therefore, it may become possible to reduce the deflection of the nip forming member 22. Further, due to the improvement of the heat insulation property, it may become possible to decrease the transfer of heat from the fixing sleeve 21 to the pressing roller 31. As a result, the efficiency of heating the fixing sleeve 21 may be improved. The elastic layer 36 may be formed of solid rubber.

Herein, since the pressing roller 31 is disposed so as to press the fixing sleeve 21 from the outer periphery side of the fixing sleeve 21, the pressing roller may be referred to as a pressing member of the present invention.

The nip forming member 22 has a plate shape and has a longitudinal length in the axis direction of the fixing sleeve 21. Further, the nip forming member 22 has a part to be in contact with the pressing roller 31 via at least the fixing sleeve 21. The part of the nip forming member 22 is formed of a resin material having thermal resistance such as LCP (Liquid Crystal Polymer), PAI (PolyAmideImide resin), PI (PolyImide resin) or the like. Further, the nip forming member 22 is held at a predetermined position on the inner periphery side of the fixing sleeve 21 by the holding member 23.

Figure 7:
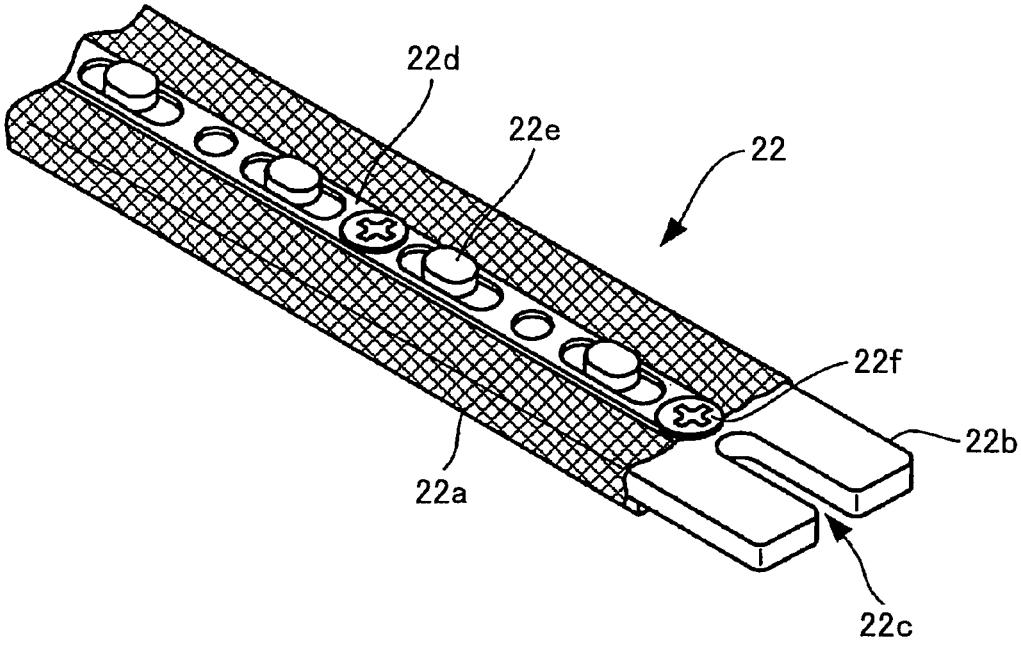
FIG. 7 is a perspective view of a nip forming member of the fixing device according to the first embodiment of the present invention.

Further, as schematically illustrated in FIG. 7, preferably, the nip forming member 22 includes a sheet member 22*a* to be used in a part where nip forming member 22 is in (slide) contact with the inner peripheral surface of the fixing sleeve 21. The sheet member 22*a* may be made of a material having excellent slidability and abrasion resistance such as a mesh sheet in which fibers of PTFE are woven, a Teflon (registered trade mark) sheet or the like. The sheet member 22*a* is wrapped around the main body of the nip forming member 22 in the middle section excepting end sections 22*b* of the nip forming member 22. The sheet member 22*a* is fixed to the main body of the nip forming member 22 by using a fixing plate 22*d* having a plate shape. The fixing plate 22*d* presses and fixes the sheet member 22*a* wrapped around the main body of the nip forming member 22 to the main body by using bolts 22*f*. By fixing the sheet member 22*a* in this way, it may become possible to prevent the sheet member 22*a* from being displaced relative to the nip forming member 22 when the nip forming member 22 is in slide contact with the fixing sleeve 21.

Further, the nip forming member 22 includes plural protruding parts 22*e* so that the protruding parts 22*e* are in contact with the protruding parts 23*a* of the holding member 23. To that end, it may be preferable that the sheet member 22*a* includes holes (not shown) at predetermined intervals so that the protruding parts 22*e* protrude (are exposed) through the holes.

Referring back to FIG. 2, as described above, the nip forming member 22 is disposed on the inner periphery side of the fixing sleeve 21, and is in press contact with the pressing roller 31 via the fixing sleeve 21 due to the pressure by the pressing roller 31 so as to form the fixing nip section 38. Therefore, the nip forming member 22 may be referred to as a contacting member of the present invention. As described above, the fixing sleeve 21 rotates while being sandwiched between the nip forming member 22 and the pressing roller 31. In this case, the upstream side of the fixing nip section 38 corresponds to the belt tension side of the fixing sleeve 21, so that the recording medium P can be introduced into the fixing nip section 38.

Further, the releasability (detachability) of the recording medium P on the downstream side of the fixing nip section 38 may depend on the shape of the most downstream side of the nip forming member 22. Because of this feature, for example, in a case where the shape of the most downstream side of the nip forming member 22 is a round shape, when the curvature is increased, the releasability is increased. On the other hand, when the curvature is decreased, the area where the nip forming member 22 is in contact with the pressing roller 31 becomes smaller, and the width of the fixing nip section 38 is decreased.

In this embodiment, the nip forming member 22 has a flat plate shape. However, the shape of the nip forming member 22 is not limited to this shape. For example, the nip forming member 22 may have a concave shape. When the shape of the nip forming member 22 is the concave shape, the discharging direction of the header of the recording medium P may be inclined to the pressing roller 31 side. As a result, the releasability of the recording medium P from the fixing sleeve 21 may be improved, thereby preventing the occurrence of the jam of the recording medium P. Further, the nip forming member 22 may have a combined shape of the flat plate shape and the concave shape in a manner that the concave shape is formed only at the exit part of the fixing nip section 38.

The first plate 29 has a U-shape and is formed of a stainless plate having a thickness of approximately 1.5 mm. Further, as illustrated in FIG. 8, the first plate 29 has grooves 43 so that the protruding parts 23*a* of the holding member 23 are in contact with the nip forming member 22 through the grooves 43.

On the other hand, the second plate 41 has the U-shape and is formed of a stainless plate having a thickness less than that of the first plate 29. Similar to the first plate 29, the second plate 41 has the grooves 43 so that the protruding parts 23*a* of the holding member 23 are in contact with the nip forming member 22 through the grooves 43. The second plate 41 is provided so as to cover the nip forming member 22 with the inner peripheral surface of the fixing sleeve 21 when the nip forming member 22 is in contact and the fixing sleeve 21. To that end, the heights of a downstream side surface section 41*a* and an upstream side surface section 41*b* of the second plate 41 are less than the height of the nip forming member 22 when the nip forming member 22 is engaged with the U shape of the second plate 41 by moving the nip forming member 22 in the arrow C direction of FIG. 8, so that the upper surface of the nip forming member 22 (i.e., the surface forming the fixing nip section 38) can be in contact with the fixing sleeve 21.

Both the first plate 29 and the second plate 41 have bolt holes, so that the first plate 29 and the second plate 41 can be fixed by bolts. Further, the first plate 29 includes plate protruding parts 29*a* extending in the axis direction of the fixing sleeve 21, so that the plate protruding parts 29*a* can be engaged with grooves formed on the respective flanges 35 (see FIG. 4). As a result, the first plate 29 and the second plate 41 are fixed to the side plates 51 (see FIG. 6) of the fixing device 20 via the flange 35.

Further, the nip forming member 22 is provided so as to be engaged with the U shape of the second plate 41. Therefore, the nip forming member 22 is also fixed to the side plates 51 of the fixing device 20 via the second plate 41, the first plate 29, and the flanges 35.

Figure 4:
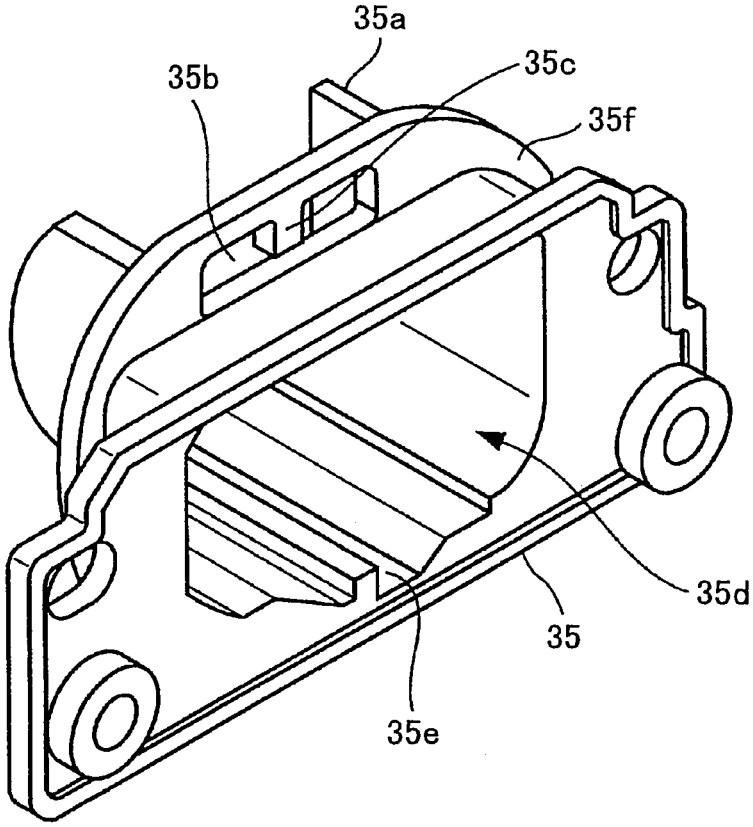
FIG. 4 is a perspective view of a flange of the fixing device according to the first embodiment of the present invention.

As illustrated in FIG. 4, the flange 35 includes a first flange part 35*a* and a second flange part 35*f*. The first flange parts 35*a* of the flanges 35 are provided to be in slide contact with the inner peripheral surface of the fixing sleeve 21 at corresponding ends (edge parts) of the fixing sleeve 21. The second flange parts 35*f* are provided to determine the position of the fixing sleeve 21 in the axis direction by being in slide contact with the corresponding edge parts of the fixing sleeve 21. Further, at the outside of the second flange parts 35*f* of the flanges 35, the flanges 35 are fixed to the corresponding side plates 51 (see FIG. 6).

Further, the flange 35 has an opening part 35*d* that contains the end section of the holding member 23. Further, the flange 35 includes a groove 35*e* that can fix the position of the holding member 23. The groove 35*e* is provided to prevent the holding member 23 being rotated in the circumferential direction. As a result, the holding member 23 can stably hold the nip forming member 22. Further, the flange 35 has another groove (not shown) to prevent the movement of the holding member 23 in the axis direction.

Further, the flange 35 has an opening part 35*b*, so that the plate protruding parts 29*a* of the first plate 29 and the end part 22*b* (see FIG. 8) of the nip forming member 22 can be inserted into the opening part 35*b*. Further, the flange 35 includes a protrusion 35*c* protruding in the opening part 35*b*. The protrusion 35*c* is provided to be engaged with a U-shaped groove 22*c* (see FIG. 7) formed in the end part 22*b* of the nip forming member 22. As a result, the first plate 29 and the nip forming member 22 are fixed to the apparatus 1, when the fixing device 20 is assembled.

Figure 5:
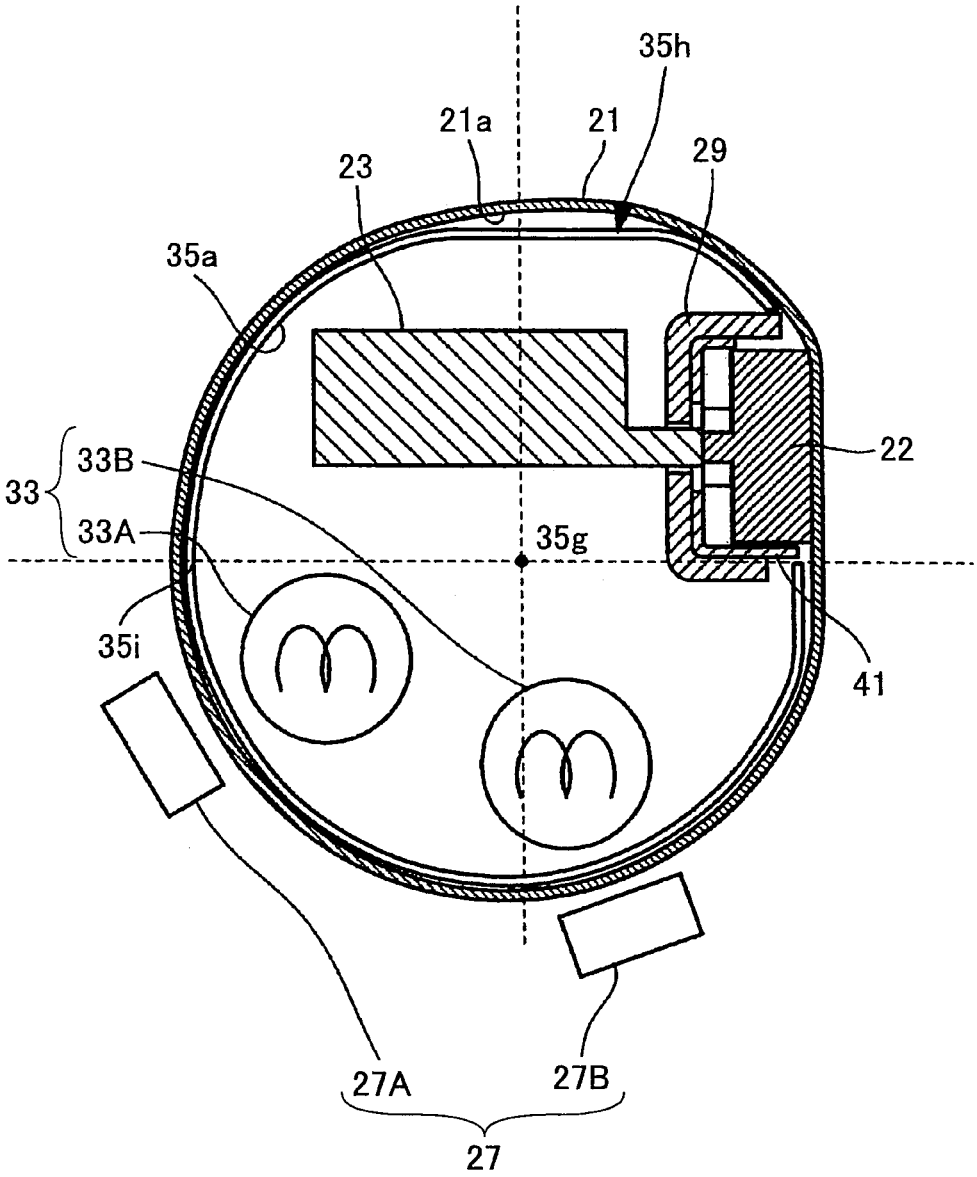
FIG. 5 is a partial cross-sectional view of the fixing device excluding a pressing roller according to the first embodiment of the present invention.

As illustrated in FIG. 5, the first flange parts 35*a* of the flanges 35 are provided so as to maintain the shape of the fixing sleeve 21 by being in slide contact with the inner peripheral surface of the fixing sleeve 21 at the corresponding ends of the fixing sleeve 21. Further, the first flange part 35*a* has an arc shape on the upstream side of the fixing nip section 38. The radius of the arc shape is substantially the same as the radius of the fixing sleeve 21. In FIG. 5, the arc axis of the arc is expressed by 35*g*. In this case, the area of the upper half may be decreased as long as the arc can contain the holding member 23 and the like. Therefore, in this embodiment, the first flange part 35*a* is formed in a manner such that the cross-sectional area of the lower half is greater than the cross-sectional area of the upper half.

Further, the first flange part 35*a* includes not a round surface part but a flat surface part 35*h* in the upper half area above the arc axis 35*g* (FIG. 5). By having the flat surface part 35*h*, it may become possible to increase the size of the area of the lower half below the arc axis 35*g* even if the circumferential length of the fixing sleeve 21 is unchanged. Further, since the first flange part 35*a* includes the flat surface part 35*h*, it may become possible to separate the fixing sleeve 21 from the first flange part 35*a* on the down stream side of the fixing nip section 38. As a result, it may become possible to reduce the amount of heat transferred from the fixing sleeve 21 to the first flange part 35*a*.

In this case, the flanges 35 are disposed at the corresponding ends of the fixing sleeve 21 and maintain the shape of the fixing sleeve 21 by being in direct and indirect slide contact with the inner peripheral surface of the fixing sleeve 21. Therefore, the flanges 35 may be referred to as a shape maintaining unit of the present invention.

As illustrated in FIG. 5, the outline of the outer shape of the flange 35 may be formed by combining plural arc shapes. Further, a part of the fixing sleeve 21 is involved in the fixing nip section 38. From this point of view, the flange 35 may have a different shape other than a round shape in response to the circumferential length of the fixing sleeve 21. The shape of the fixing sleeve 21 becomes a shape corresponding to the outer shape of the flange 35.

Figure 6:
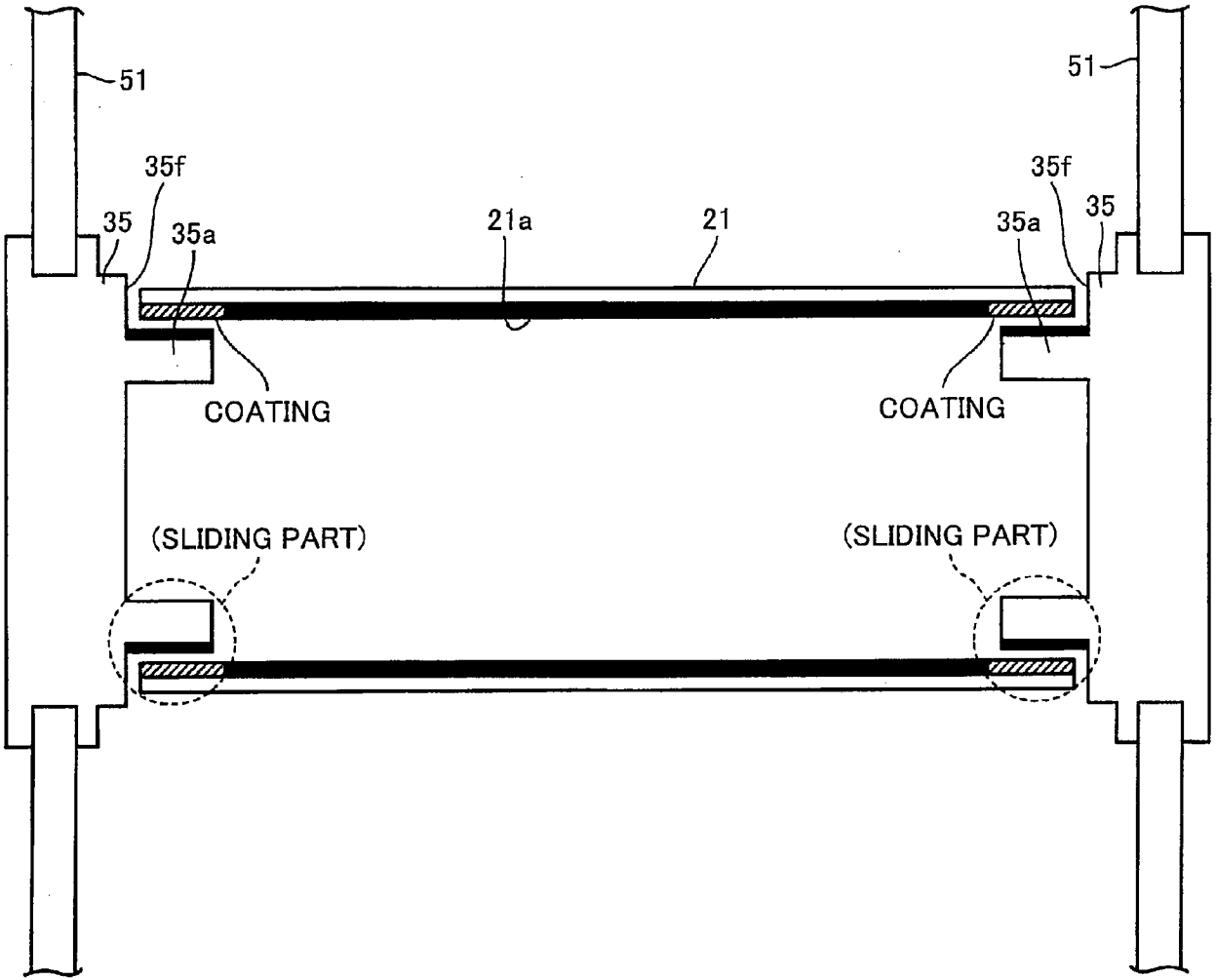
FIG. 6 is a schematic cross-sectional view of the fixing sleeve and the flange according to the first embodiment of the present invention.

As illustrated in FIG. 6, the inner peripheral surface 21*a* of the fixing sleeve 21 includes the area where the fixing sleeve 21 is not in slide contact with the flanges 35. This area is painted (coated) black, so that the inner peripheral surface 21*a* of the fixing sleeve 21 in the area can effectively absorb the radiation heat from the heat source disposed on the inner periphery side of the fixing device 21. By doing this, it may become possible to effectively transfer the heat from the heat source to the surface of the fixing sleeve 21 in the center area of the fixing sleeve 21 in the longitudinal (axis) direction of the fixing sleeve 21 (i.e., in the area corresponding to the area of the fixing nip section 38 where unfixed toner is to be permanently fixed). In the above description, a case is described where the inner peripheral surface 21*a* of the fixing sleeve 21 is coated black. However, the present invention is not limited to this configuration. For example, the fixing sleeve having a black inner peripheral surface may alternatively be used. In this case, a coating process may be omitted.

On the other hand, coating may be performed on the areas (hatched area in FIG. 6) which correspond to both end sections (edge parts) of the inner peripheral surface 21*a* of the fixing sleeve 21 and where the fixing sleeve 21 is in slide contact with the first flange parts 35*a*. For example, the coating includes fluorochemical coating such as PFA coating and PTFA coating. By coating in this way, it may become possible to reduce the sliding resistance of the fixing sleeve 21 to the flanges 35. Especially, the fixing sleeve 21 is rotated in accordance with the rotation of the pressing roller 31. Because of this feature, when the sliding resistance of the fixing sleeve 21 to the flanges 35 is increased, the rotating shape of the fixing sleeve 21 may be accordingly changed. From the point of view, by coating as described above, it may become possible to reduce the change of the rotating shape of the fixing sleeve 21 and maintain stable rotation of the fixing sleeve 21. In the description above, a case is described where the coating is applied on the parts of the fixing sleeve 21. However, the present invention is not limited to this configuration. For example, grease may alternatively be applied.

Further, in the above description, a case is described where the coating is applied on the end sections of the fixing sleeve 21 and the center area of the fixing sleeve 21 is coated black. However, the present invention is not limited to this configuration. For example, black coating having a low friction coefficient may be applied to the entire inner peripheral surface of the fixing sleeve. In this case, it may become possible to improve the efficiency of the heat transfer and reduce the sliding resistance at the same time. Further, the processing cost of the fixing device 20 may also be reduced.

As described above, according to this embodiment, it may become possible to reduce the sliding resistance of the fixing sleeve 21 and the energy consumption of the driving motor (not shown) to rotate the fixing sleeve 21 via the pressing roller 31. As a result, the energy consumption in the fixing device according to this embodiment may be reduced when compared with a fixing device in the related art. Further, it may become possible to reduce the slippage of the fixing sleeve 21 relative to the pressing roller 31, the slippage being caused by higher sliding resistance.

In FIG. 2, there are depicted two horizontal (dashed-dotted) lines. The horizontal (dashed-dotted) line passing a point 31*a* in the pressing roller 31 is herein called a first central axis line X. On the other hand, the horizontal (dashed-dotted) line passing the point 35*g* in the fixing sleeve 21 is herein called a second central axis line Y. In this embodiment, those two lines (X and Y) are not superimposed in the same line. Actually, the second central axis line Y of the fixing sleeve 21 is disposed on the upstream side of the fixing nip section 38 relative to the first central axis line X of the pressing roller 31 by a distance D. The symbol D in FIG. 2 denotes the displacement of the central axis.

Herein, the pressing roller 31 has a central axis 31*a* which corresponds to the rotation center of the pressing roller 31. The first central axis line X is the line passing through the central axis 31*a* and extending in the cross-sectional direction of the pressing roller 31 and in the direction orthogonal to the feeding direction of the recording medium P.

On the other hand, as described above, the flange 35 has its arc axis 35*g*. The second central axis line Y is the line passing through the arc axis 35*g* and extending in the cross-sectional direction of the flange 35 and in the direction orthogonal to the feeding direction of the recording medium P. In this embodiment, the arc axis 35*g* refers to the center of the arc having a fixed curvature R and formed as a part of the first flange part 35*a* on the upstream side of the fixing nip section 38. When the first flange part 35*a* does not have an arc having a fixed curvature R, the position of 35*g* may be defined as the center of the maximum line among the lines within (i.e., between the upper and lower parts of) the first flange part 35*a* and extending in the direction parallel to the feed direction of the recording medium P.

Therefore, the first central axis line X connecting between (passing through) the central axis 31*a* of the pressing roller and a substantial center 31*b* of the fixing nip section 38 is separated from the second central axis line Y connecting between (passing through) the arc axis 35*g* and a point 35*i* where the arc of the first flange part 35*a* is terminated on the side opposite to the side of the fixing nip section 38 by the distance D.

To that end, the heater 33 is disposed on the upstream side of the first central axis line X in the feeding direction, and the holding member 23 is disposed on the downstream side of the second central axis line Y in the feeding direction.

As described above, the shape of the fixing sleeve 21 may be maintained based on the shape of the first flange part 35*a* of the flange 35. Namely, various shapes of the fixing sleeve 21 may be formed based on the shape of the first flange part 35*a* of the flange 35. Because of this feature, it may become possible to dispose the heat source in a more appropriate position when compared with the related art. Further, it may become possible to reduce the circumferential length of the fixing sleeve 21. As a result, the size of the fixing device may be reduced.

Furthermore, the nip forming member 22 is eccentrically disposed on the upper side in the fixing sleeve 21 (see FIG. 2). Therefore, it may become possible to increase the space for disposing the heater 33 on the upstream side of the fixing nip section 38. Accordingly, the number of the heaters 33 (heat sources) to be disposed may be increased. When plural heaters can be disposed, for example, the plural heaters may be arranged in the axis direction of the fixing sleeve 21. As a result, it may become possible to heat the fixing sleeve 21 more accurately. In the example of FIG. 2, a case is described where two heaters are disposed. However, the number of the heaters may be one or more than two.

Next, operations of the fixing device 20 are described with reference to FIG. 2.

First, when receiving an output signal from the image forming apparatus 1 (e.g., when a user operates an operation panel or a personal computer and transmits a print request to the image forming apparatus), in the fixing device 20, a pressing and depressing member (not shown) drives the pressing roller 31, so that the pressing roller 31 presses the nip forming member 22 via the fixing sleeve 21 to form the fixing nip section 38.

Next, when the pressing roller 31 is rotated in the clockwise direction (i.e., the arrow B direction) of FIG. 2 by a driving device (not shown), the fixing sleeve 21 is rotated in the counterclockwise direction (i.e., the arrow A direction) of FIG. 2. In this case, due to the positional relationship between the fixing nip section 38 and the flanges 35, tension is applied to the fixing sleeve 21 in a predetermined area (in the case of FIG. 2, the lower side of the second central axis line Y). Therefore, the fixing sleeve 21 is able to be in slide contact with the nip forming member 22 at the upstream side of the fixing nip section 38.

Upon the operation of the driving device, power is supplied to the heater 33 from an external power supply or an internal electric storage device. Then, heat is effectively transferred in circumferential direction and in the entire width direction of the fixing sleeve 21 by the heater 33, so that the fixing sleeve 21 is rapidly heated. However, it is not always necessary to start the operation of the driving device and the heat by the heater 33 at the same time. An appropriate time shift may be applied to start separately.

In this case, heat is controlled by the heater 33 so that the temperature of the fixing nip section 38 is substantially equal to a predetermined temperature by using the temperature sensor 27 which is or is not in contact with the fixing sleeve 21. When the temperature is increased to the necessary (predetermined) temperature, the temperature is controlled to be maintained, and the introduction of the recording medium P into the fixing nip section 38 is started.

As described above, in the fixing device 20 in this embodiment, the heat capacity of the fixing sleeve 21 and the heater 33 is relatively small. Therefore, it may become possible to reduce the warm-up time and the first printing time while reducing the energy consumption.

Normally, when no output signal is transmitted to the image forming apparatus, to reduce the power consumption, the rotation of the pressing roller 31 and the fixing sleeve 21 is stopped and the power applied to the heater 33 is also stopped. However, in this embodiment, when it is necessary to output (restart) instantly, it may be possible to supply power to the heater 33 while stopping the rotation of the pressing roller 31 and the fixing sleeve 21. In this case, the power may be supplied to the heater 33 so that the temperature of the entire fixing sleeve 21 can be maintained.

As described above, in the fixing device according to this embodiment, it may become possible to increase the space on the upstream side of the holding member 23 (nip forming member 22) and on the inner periphery side of the fixing sleeve 21. Because of this feature, it may become possible to dispose the heat source at desirable positions and reduce the circumferential length of the fixing sleeve 21. Therefore, the size of the fixing device 20 according to this embodiment may be reduced when compared with the fixing device of the related art. As a result, the power consumption of the fixing device 20 according to this embodiment may also be reduced when compared with the fixing device of the related art.

Further, due to the flanges 35, the fixing sleeve 21 may rotationally slide along the first flange parts 35*a* of the flanges 35. As a result, the shape (cylindrical shape) of the fixing sleeve 21 may be maintained.

Further, in the fixing device of this embodiment, the halogen heater generating radiation heat is used as the heater 33. Because of this feature, the fixing sleeve 21 may be directly heated by the radiation heat. As a result, it may become possible to effectively heat the fixing sleeve 21.

Further, in the fixing device of this embodiment, the color of the inner peripheral surface of the fixing sleeve 21 is black. Because of this feature, the absorption rate of the radiation heat may be increased. As a result, it may become possible to effectively control the temperature to a predetermined temperature.

Further, in the fixing device of this embodiment, the heater 33 includes the first heater 33A and the second heaters 33B. The first heater 33A heats the center region in the longitudinal direction of the fixing sleeve 21. The second heaters 33B heat the respective end regions in the axis direction of the fixing sleeve 21. Further, the sensor 27 includes the first temperature sensor 27A and the second temperature sensors 27B. The first temperature sensor 27A is disposed at a position corresponding to the position where the first heater 33A radiates heat most. In the same manner, the second temperature sensors 27B are disposed at positions corresponding to the positions where the second heaters 33B radiate heat most. Because of this feature, it may become possible to accurately detect the temperatures of the heat generating portions.

Further, the image forming apparatus of this embodiment includes the fixing device 20 described above, so that the fixing device 20 may become smaller than the fixing device of the related art. Because of this feature, the energy consumption of the entire image forming apparatus may be reduced and the warm-up time may also be reduced. Further, good fixing performance and uniform image gloss may be obtained. Therefore, it may become possible to provide an image forming apparatus having high usability.

Instead of the fixing device of the first embodiment described above, in a second embodiment of the present invention, the fixing device includes a heat conducting member made of metal. Therefore, the image forming apparatus may include the fixing device of the second embodiment described below.

Second Embodiment

Next, an image forming apparatus according to the second embodiment of the present invention is described with reference to FIGS. 9 through 11.

The configuration of the image forming apparatus in the second embodiment differs from that of the image forming apparatus in the first embodiment in that the image forming apparatus in the second embodiment further includes the heat conducting member made of metal. Namely, besides the heat conducting member made of metal, the configuration of the image forming apparatus in the second embodiment is substantially equal to that of the image forming apparatus in the first embodiment. Therefore, the same reference numerals are used in the description of the second embodiment for the same or equivalent elements in the description of the first embodiment and FIGS. 1 through 8, and the repeated descriptions herein may be omitted.

Figure 9:
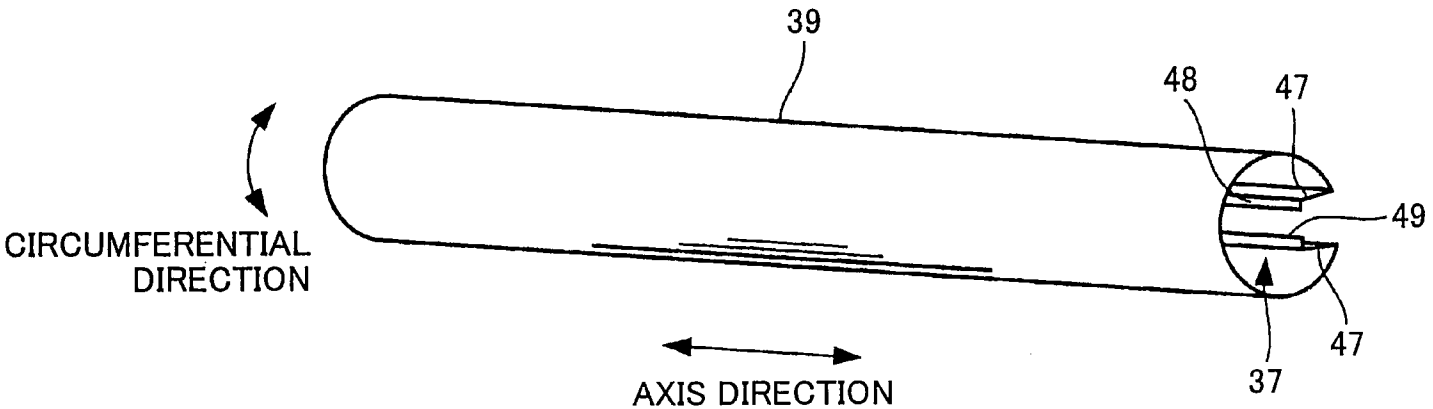
FIG. 9 is a perspective view of a heating member of the fixing device according to a second embodiment of the present invention.

FIG. 9 illustrates a heating member 39 made of iron as the heat conducting member. As illustrated in FIG. 9, the heating member 39 is made of a pipe-shaped member having a c-shaped cross section and the thickness of approximately 0.1 mm. The heating member 39 is formed so that the heating member 39 faces the inner peripheral surface of the fixing sleeve 21 at the positions other than the position corresponding to the fixing nip section 38. Further, in an inner part 37 (the inside) of the heating member 39, the shape of the heating member 39 at the position corresponding to the fixing nip section 38 is formed in a concave shape (or in a U shape), and an opening 49 is formed. The nip forming member 22 is engaged in the position where the heating member 39 has the concave shape with clearance.

Figure 10:
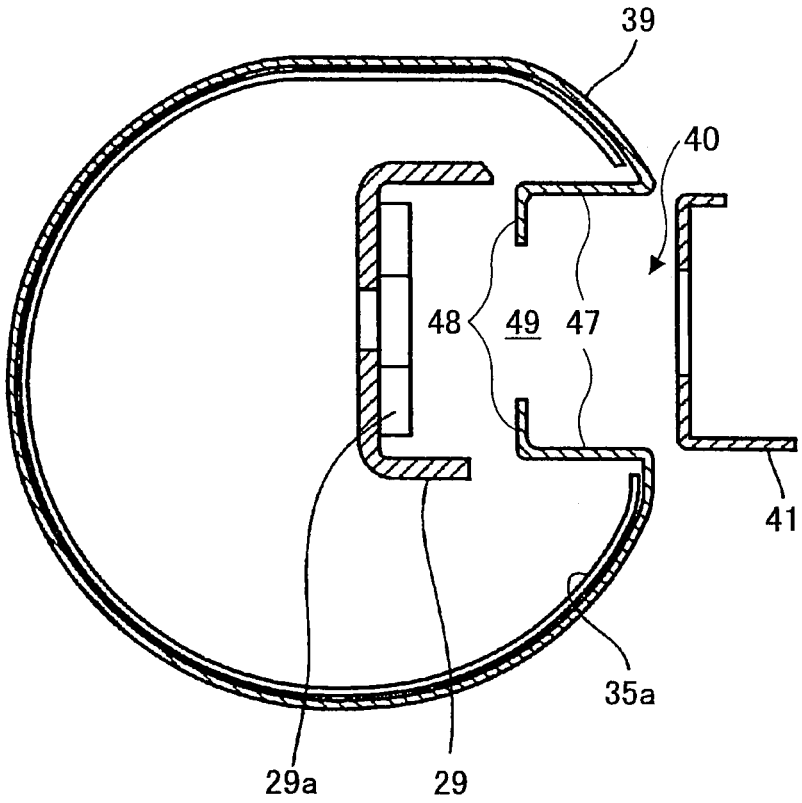
FIG. 10 is partial cross-sectional view of the fixing device according to the second embodiment of the present invention.
Figure 11:
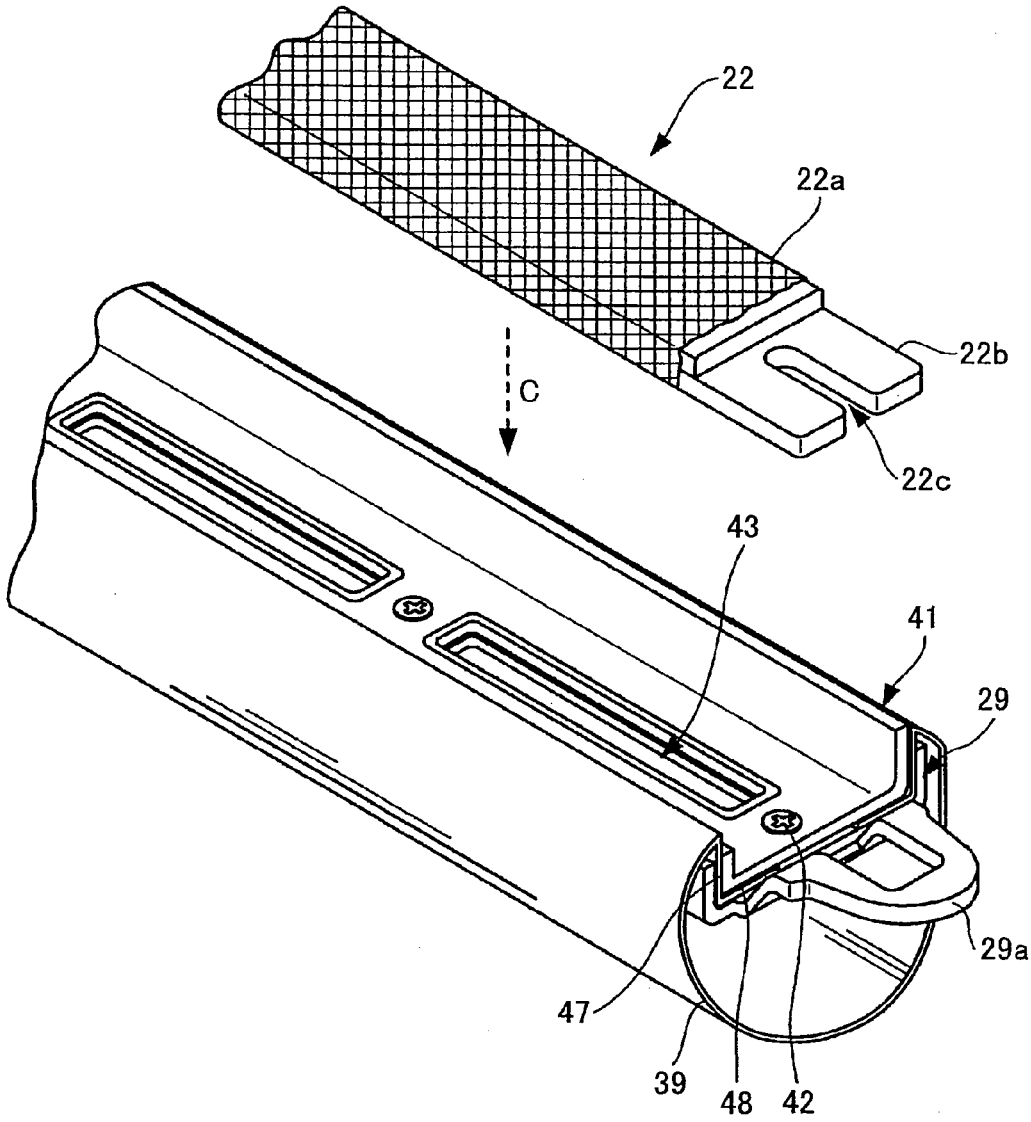
FIG. 11 is an exploded perspective view of the parts of the fixing sleeve of the fixing device according to the second embodiment of the present invention.

As schematically illustrated in FIG. 10, the end sections of the heating member 39 in the width direction are fixed to the fixing device 20 via the corresponding first flange parts 35*a*.

Further, the heating member 39 is heated by the radiation heat from the heater 33 disposed on the inner periphery side of the heating member 39. The fixing sleeve 21 is heated by the heated heating member 39. Namely, the heating member 39 is directly heated by the heater 33, and the fixing sleeve 21 is indirectly heated by the heater 33 via the heating member 39.

The heating member 39 is made of metal having high thermal conductivity such as aluminum, iron, stainless or the like. To improve the heat efficiency, it may be preferable that the thickness of the heating member 39 is equal to or less than 0.2 mm, because when the heat efficiency of the heating member 39 is increased, the heat efficiency of the fixing sleeve 21 may also be increased. In this embodiment, the heating member 39 is made of stainless.

In this embodiment, in a heating area (i.e., the area on the upstream side of the fixing nip section 38 where the radiation heat from the heater 33 is not blocked (stopped) by the holding member 23), the heating member 39 is in slide contact with the fixing sleeve 21, or a gap δ equal to or less than 0.3 mm is formed between the heating member 39 and the fixing sleeve 21. In any of the configurations, it may become possible to effectively heat the fixing sleeve 21 by the heating member 39. However, to improve the heat efficiency, it may be preferable that the heating member 39 and the fixing sleeve 21 are in slide contact with each other. However, when the heating member is in close contact with the fixing sleeve 21 in the heating area, the contact pressure between the heating member 39 and the fixing sleeve 21 may become too high, so that the torque of the fixing sleeve 21 may become greater and the abrasion may be accelerated. In this case, it may be preferable that the contact pressure between the heating member 39 and the fixing sleeve 21 is equal to or less than 0.3 kgf/cm$^2$.

As described above, the heating member 39 is disposed on the inner periphery side of the fixing sleeve 21 and has a pipe shape so as to support the rotation of the fixing sleeve. Therefore, the heating member 39 may be referred to as a rotation supporting member of the present invention. By having the heating member 39 in this embodiment, it may become possible to rotatably support the fixing sleeve 21 and maintain the shape of the fixing sleeve 21. As a result, it may become possible to reduce the deflection of the fixing sleeve 21.

Further, the fixing sleeve 21 is in slide contact with the heating member 39.

As illustrated in FIG. 10, the heating member 39 has a C-type pipe shape and includes a nip concave part 40 on one end of the heating member 39 to house (contain) the nip forming member 22.

The nip concave part 40 includes two side walls 47 arranged in parallel and extending to the inside of the heating member 39, two bottom walls 48 arranged at the ends of the respective side walls 47 and opposite to one another and forming a U-shaped bottom of the nip concave part 40. Between the bottom walls 48 of the nip concave part 40, an opening 49 is formed. As illustrated in FIGS. 10 and 11, the second plate 41 having a substantially U-shape is engaged with the outside of the nip concave part 40 (i.e., the inside of the heating member 39). On the other hand, the first plate 29 having a substantially U-shape is engaged with the inside of the nip concave part 40. The second plate 41 and the first plate 29 sandwich the side walls 47 and the bottom walls 48 and are screwed to be fixed to each other. By being fixed to the second plate 41 and the first plate 29, the shape of the nip concave part 40 may be maintained.

Further, to reduce the abrasion resistance of the fixing sleeve 21, fluorine grease as a lubricant is applied to the outer peripheral surface of the heating member 39. However, the present invention is not limited to this configuration. For example, to reduce the sliding resistance between the heating member 39 and the fixing sleeve 21, the sliding surface of the heating member 39 may be formed of a material having a lower friction coefficient. Otherwise, for example, a surface layer made of a material including fluorine may be formed on the inner peripheral surface 21*a* of the fixing sleeve 21.

Further, in this embodiment, as illustrated in FIG. 10, the heating member 39 is formed so as to have a similar shape to that of the first flange part 35*a* of the flange 35, so that the inner peripheral surfaces at the end sections of the heating member 39 are in slide contact with the outer peripheral surfaces of the first flange parts 35*a*. By forming the heating member 39 in this way, the heating member 39 may be fixed to the flanges 35 at the end sections of the heating member 39. Further, the shape of the fixing sleeve 21 being in slide contact with the outer peripheral surface of the heating member 39 depends on the shape of the heating member 39. Therefore, the shape of the fixing sleeve 21 may be substantially the same as the shape described in the above first embodiment.

As described above, the fixing device in this embodiment further includes the heating member 39 as the rotation supporting member in addition to the elements of the first embodiment. By having the heating member 39, it may become possible to rotatably support the fixing sleeve 21 and maintain the shape of the fixing sleeve 21. As a result, it may become possible to reduce the deflection of the fixing sleeve 21.

Instead of using the fixing device of the first embodiment described above, a fixing device of a third embodiment using not the halogen heater but a sheet heating element may be used.

Third Embodiment

Next, an image forming apparatus according to the third embodiment of the present invention is described.

The configuration of the image forming apparatus in the third embodiment differs from that of the image forming apparatus in the first embodiment in that the image forming apparatus in the third embodiment includes the sheet heating member instead of the halogen heater. Namely, besides the sheet heating member, the configuration of the image forming apparatus in the third embodiment is substantially equal to that of the image forming apparatus in the first embodiment. Therefore, the same reference numerals are used in the description of the third embodiment for the same or equivalent elements in the description of the first embodiment and FIGS. 1 through 8, and the repeated descriptions herein may be omitted.

In the following, the fixing device in the third embodiment is described with reference to FIG. 12 (mainly) and FIGS. 4 through 8 (supplementally).

Figure 12:
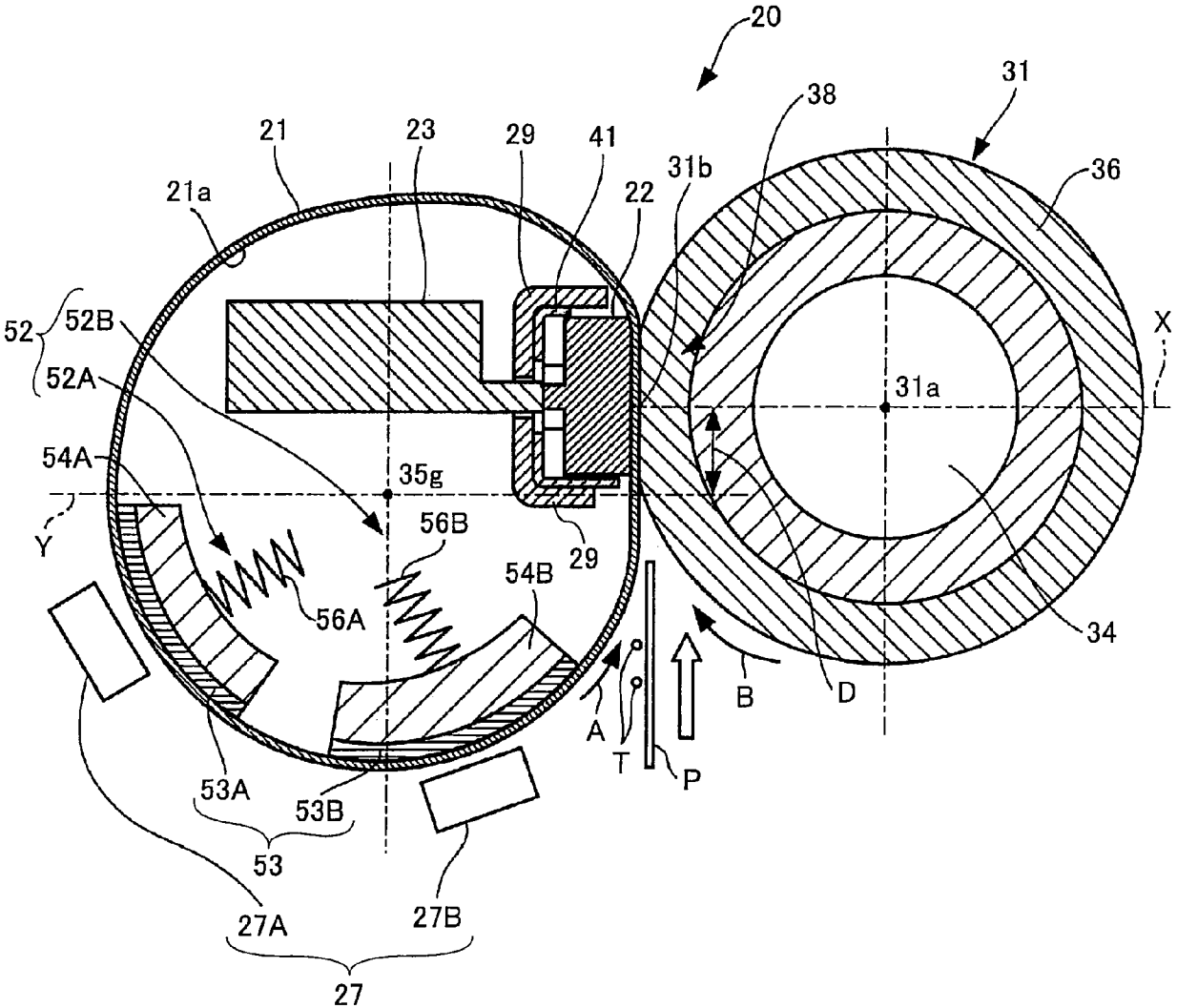
FIG. 12 is a partial cross-sectional view of the fixing device according to a third embodiment of the present invention.

As schematically illustrated in FIG. 12, the fixing device 20 of the third embodiment includes a sheet heating element 53 as the heat source. The sheet heating element 53 is a sheet-like heating member and is in slide contact with the fixing sleeve 21 so as to transfer the heat generated by the sheet heating element 53 to the fixing sleeve 21. Further, the fixing device 20 includes a first sheet heating element 53A and a second sheet heating element 53B. Both end sections of the first and the second sheet heating elements 53A and 53B protrude through the respective openings of the flanges 35 and are fixed to the main body of the fixing device 20. Further, a pressing mechanism 52 is provided to press the sheet heating element 53 to the fixing sleeve 21. More specifically, the pressing mechanism 52 includes a first pressing mechanism 52A and a second pressing mechanism 52B. The first and the second pressure mechanisms 52A and 52B press the first and the second sheet heat elements 53A and 53B, respectively. The first and the second pressure mechanisms 52A and 52B include first and second press support members 54A and 54B (hereinafter may be collectively referred to as a press support member 54) and spring members 56A and 56B (hereinafter may be collectively referred to as spring member 56 as biasing member, respectively. The first and the second press support members 54A and 54B are provided to press the first and the second sheet heating elements 53A and 53B so that the first and the second sheet heating elements 53A and 53B, respectively, are in close contact and press the fixing sleeve 21. The spring members 56A and 56B are provided to bias the first and the second press support members 54A and 54B so that the first and the second press support members 54A and 54B, respectively, press the fixing device 21. The spring members 56A and 56B may be referred to as a pressing member of the present invention.

Further, the first sheet heating element 53A is provided so as to mainly heat the center part which is the center region in the axis direction of the fixing sleeve 21. To that end, the first sheet heating element 53A has a heat distribution in which higher heat is generated in a region corresponding to the center region in the axis (longitudinal) direction of the fixing sleeve 21. On the other hand, the second sheet heating elements 53B are provided so as to mainly heat the respective edge sections which are the end regions in the axis direction of the fixing sleeve 21. To that end, the second sheet heating elements 53B have a heat distribution in which higher heat is generated in regions corresponding to the edge regions in the axis (longitudinal) direction of the fixing sleeve 21. Therefore, the first and the second sheet heating elements 53A and 53B directly heat the fixing sleeve 21. Therefore, the first and the second sheet heating elements 53A and 53B may be collectively referred to as a heating unit of the present invention.

The temperature sensor 27 is provided so as to face a surface of the fixing sleeve 21. As the temperature sensor 27, a known thermistor or the like may be used. The temperature sensor 27 includes a first temperature sensor 27A and second temperature sensors 27B. The first temperature sensor 27A is disposed at a position facing the center region in the longitudinal direction of the fixing sleeve 21 so as to detect the temperature of the first sheet heating element 53A. The second temperature sensors 27B are disposed at positions facing the respective end regions in the longitudinal direction of the fixing sleeve 21 so as to detect the temperatures of the second sheet heating elements 53B. The first temperature sensor 27A may be referred to as a center section temperature detecting unit of the present invention, and the second temperature sensors 27B may be referred to as an end section temperature detecting unit of the present invention.

To highly accurately control the temperature of the thin fixing sleeve 21 having low heat capacity, it is highly preferable that the sensors 27A and 27B are disposed at the positions close enough to the positions where the sheet heating element 53 irradiates heat most in the longitudinal direction of the fixing sleeve 21.

As described above, the first and the second temperature sensors 27A and 27B are disposed at the positions close enough to the respective center sections and the end sections. Therefore, it may become possible to highly accurately detect the temperatures and accordingly highly accurately control the temperature on the fixing sleeve 21. As a result, it may become possible to improve the image quality. Further, it is preferable for the first and the second temperature sensors 27A and 27B to detect the temperatures without directly contacting the fixing sleeve 27 so as not to cause damage to the fixing sleeve 21 due to the direct slide contact. As a contactless sensor, the thermopile, contactless thermistor and the like may be used. As a contact sensor, the contact thermistor may be used.

Further, power is supplied to the first and the second sheet heating elements 53A and 53B from a power supply section of the image forming apparatus 1, and the power is controlled by a control section (not shown) in the image forming apparatus 1. The control section acquires signals indicating the detection results of the temperatures of the surface of the fixing sleeve 21, and controls the heat output from the first and the second sheet heating elements 53A and 53B based on the acquired signals. Further, the control section controls the temperature of the fixing sleeve 21 to be a desired temperature by turning on and off the first and the second sheet heating element 53A and 53B.

Further, the press support member 54 is provided on a surface of the sheet heating element 53, the surface being opposite to the surface on which the fixing sleeve 21 is in (slide) contact with the sheet heating element 53. The press support member 54 includes the first and the second press support members 54A and 54B. The first and the second press support members 54A and 54B press the first and the second sheet heating elements 53A and 53B, respectively, to the fixing sleeve 21.

The press support member 54 is provided so as to press the sheet heating element 53 to the fixing sleeve 21. To have uniformly close contact between the surface of the sheet heating element 53 and the fixing sleeve 21, it is preferable that the press support member 54 is formed of, for example, expandable silicone rubber or silicon rubber. When the press support member 54 is made of an elastic material, it may become possible to maintain a uniform surface pressure across the sheet heating element 53, and as a result, it may become possible to effectively transfer heat from the sheet heating element 53 to the fixing sleeve 21. It is preferable that the material of the press support member 54 has thermal resistance and elasticity in addition to the characteristics described above. In that sense, fluorine-containing rubber may also be used. Further, when the thermal conductivity of the press support member 54 is low, it may become possible to reduce the heat transfer from the sheet heating element 53 to the press support member 54. As a result, the heat from the sheet heating element 53 may be more efficiently transferred to the fixing sleeve 21, and energy consumption may be reduced.

First ends of the first and the second spring members 56A and 56B are respectively fixed to the first and the second press support members 54A and 54B. Second ends of the first and the second spring members 56A and 56B are fixed to a supporting member (not shown). The supporting member is provided so that the first and the second spring members 56A and 56B are fixed to their desired positions. The supporting member is fixed to the fixing device 20.

Further, to acquire more stable pressure distribution between the fixing sleeve 21 and the sheet heating element 53, a rigid body (not shown) may be provided between the press support member 54 and the spring member 56. As the rigid body, a plate, a metal body or the like may be used. By providing the rigid body, it may become possible to substantially uniformly distribute the (biasing) force applied from the spring member 56 to the press support member 54.

To dispose the sheet heating element 53, the press support member 54, the spring member 56, and the rigid body on the inner periphery side of the fixing sleeve 21, the space for the sheet heating element 53, press support member 54, spring member 56, and the rigid body may be acquired by setting the first central axis line X described below to be separated from the second central axis line Y by a distance. Namely, when compared with the fixing device in the related art where the first central axis line X is not separated from the second central axis line Y in the feeding direction of the recording medium P, it may become possible to reduce the circumferential length of the fixing sleeve 21. As a result, the heat capacity of the fixing device may be reduced and the energy consumption may also be reduced.

By having the structure as described above, the fixing sleeve 21 may enter into the fixing nip section 38 while the fixing sleeve 21 is especially heated by the sheet heating element 53 at the position on the upstream side of the recording medium P (the fixing nip section 38) and near the fixing nip section 38. As a result, sufficient heat may be transferred from the surface of the heated fixing sleeve 21 to the toner image T on the recording medium P.

As described above, in the fixing device 20 according to this embodiment of the present invention, the fixing sleeve 21 is especially heated by the sheet heating element 53 along the circumferential direction focusing on the area on the upstream side of the fixing nip section 38 in the circumferential direction and close to the fixing nip section 38. Because of this feature, even when the recording medium P is fed fast, sufficient heat may be transferred to the fixing sleeve 21 and a fixing failure may be prevented. As a result, since the fixing sleeve 21 may be efficiently heated with a relatively simple configuration as described above, the warm-up time and the first printing time may be reduced and the size of the device may also be reduced.

The holding member 23 holds the nip forming member 22 that forms the fixing nip section 38. The holding member 23 is provided on the inner periphery side of the fixing sleeve 21. Since the holding member 23 holds the position of the nip forming member 22 relative to the pressing direction of the pressing roller 31, the holding member 23 may be referred to as a holding member of the present invention.

Further, the holding member 23 has the length substantially equal to the length of the nip forming member 22. The ends of the holding member 23 in the width direction are fixed to the main body via the flanges 35. The holding member 23 is formed of a metal material having higher mechanical strength such as stainless, iron or the like. By having the features, when the holding member 23 is in contact with the pressing roller 31 via the nip forming member 22 and the fixing sleeve 21, it may become possible to prevent the nip forming member 22 from being greatly deformed by the pressure applied from the pressing roller 31. As described above, the holding member 23 holds the nip forming member 22 relative to the pressing direction of the pressing roller 31. Further, as illustrated in FIG. 8, the holding member includes the protruding parts 23*a* that engage the nip forming member 22.

The holding member 23 may be heated by the radiation heat from the heater 53 or the like. Therefore, adiabatic treatment or mirror treatment is performed on the surface of the holding member 23. Due to such treatment, it may become possible to prevent the holding member from being heated and reduce unnecessary energy consumption.

Referring back to FIG. 12, as a pressing rotator, the pressing roller 31 is in press contact with an outer peripheral surface of the fixing sleeve 21 so as to form the desired fixing nip section 38 between the pressing roller 31 and the fixing sleeve 21. In this embodiment, the diameter of the pressing roller 31 is approximately 30 mm. Further, the pressing roller 31 is formed by forming an elastic layer 36 on a core metal 34 having a hollow structure. The elastic layer 36 of the pressing roller 31 is formed of a material such as silicone rubber, expandable silicone rubber, and fluorine-containing rubber. The pressing roller 31 may further include a thin releasing layer formed on the surface layer of the elastic layer 36 and formed of a material including PFA, PTFE or the like. The pressing roller 31 is biased to the fixing sleeve 21 side by a spring or the like (not shown). When the elastic layer 36 (rubber layer) is deformed, the desired fixing nip section 38 having a desired with may be formed. The pressing roller 31 may be solid roller. However, when the pressing roller 31 has the hollow structure, the heat capacity may be reduced.

The pressing roller 31 is driven to be rotated in the arrow B direction of FIG. 12 by a driving mechanism (not shown). Further, both of the end sections in the width direction of the pressing roller 31 are rotatably supported by the fixing device 20 by bearing joints (not shown). Further, the pressing roller 31 may further include a heat source such as the halogen heater inside the pressing roller 31.

When the elastic layer 36 of the pressing roller 31 is formed of a sponge-like material such as expandable silicone rubber, the pressing force to be applied to the fixing nip section 38 may be reduced. Therefore, it may become possible to reduce the deflection of the nip forming member 22. Further, due to the improvement of the heat insulation property, it may become possible to decrease the conductivity (transfer) of heat from the fixing sleeve 21 to the pressing roller 31. As a result, the efficiency of heating the fixing sleeve 21 may be improved. The elastic layer 36 may be formed of solid rubber.

Herein, since the pressing roller 31 is disposed so as to press the fixing sleeve 21 from the outer periphery side of the fixing sleeve 21, the pressing roller may be referred to as a pressing member of the present invention.

The nip forming member 22 has a plate shape and has a longitudinal length in the axis direction of the fixing sleeve 21. Further, the nip forming member 22 has a part to be in contact with the pressing roller 31 via the fixing sleeve 21. The part of the nip forming member 22 is formed of an elastic material having thermal resistance such as fluorine rubber. Further, the nip forming member 22 is held at a predetermined position on the inner periphery side of the fixing sleeve 21 by the holding member 23.

Further, as schematically illustrated in FIG. 7, preferably, the nip forming member 22 includes a sheet member 22*a* to be used in a part where the fixing sleeve 21 is in (slide) contact with the inner peripheral surface of the fixing sleeve 21. The sheet member 22*a* may be made of a material having excellent slidability and abrasion resistance such as the Teflon (registered trade mark) sheet. The sheet member 22*a* is wrapped around the main body of the nip forming member 22 in the middle section excepting both of end sections 22*c* of the nip forming member 22. The sheet member 22*a* is fixed to the main body of the nip forming member 22 by using a fixing plate 22*d* having a plate shape. The fixing plate 22*d* presses and fixes the sheet member 22*a* wrapped around the main body of the nip forming member 22 to the main body by using bolts 22*f*. By fixing the sheet member 22*a* in this way, it may become possible to prevent the sheet member 22*a* from being displaced relative to the nip forming member 22 when the nip forming member 22 is in slide contact with the fixing sleeve 21.

Further, the nip forming member 22 includes plural protruding parts 22*e* so that the protruding parts 22*e* are in contact with the protruding parts 23*a* of the holding member 23. To that end, it may be preferable that sheet member 22*a* includes holes (not shown) at predetermined intervals so that the protruding parts 22*e* protrude (expose) through the holes.

Referring back to FIG. 12, as described above, the nip forming member 22 is disposed on the inner periphery side of the fixing sleeve 21, and is in press contact with the pressing roller 31 via the fixing sleeve due to the pressure by the pressing roller 31 so as to form the fixing nip section 38. Therefore, the nip forming member 22 may be referred to as a contacting member of the present invention. As described above, the fixing sleeve 21 rotates while being sandwiched between the nip forming member 22 and the pressing roller 31. In this case, the upstream side of the fixing nip section 38 corresponds to the belt tension side of the fixing sleeve 21, so that the recording medium P can be introduced into the fixing nip section 38.

Further, the releasability (detachability) of the recording medium P on the downstream side of the fixing nip section 38 may depends on the shape on the most downstream side of the nip forming member 22 (pressing roller 31). Because of this feature, for example, in a case where the shape of the most downstream side of the nip forming member 22 is a round shape, when the curvature R is increased, the releasability is increased. On the other hand, when the curvature R is decreased, the area where the nip forming member 22 is in contact with the pressing roller 31 becomes smaller, and the width of the fixing nip section 38 is also decreased.

In this embodiment, the nip forming member 22 has a flat plate shape. However, the shape of the nip forming member 22 is not limited to this shape. For example, the nip forming member 22 may have a concave shape. When the shape of the nip forming member 22 is the concave shape, the discharging direction of the header of the recording medium P may be inclined to the pressing roller 31 side. As a result, the releasability of the recording medium P from the fixing sleeve 21 may be improved, thereby preventing the occurrence of the jam of the recording medium P. Further, the nip forming member 22 may have a combined shape of the flat plate shape and the concave shape in a manner that the concave shape is formed only at the exit part of the fixing nip section 38.

The first plate 29 has a U-shape and is formed of a stainless plate having a thickness of approximately 1.5 mm. Further, as illustrated in FIG. 8, the first plate 29 has grooves 43 so that the protruding parts 23*a* of the holding member 23 are in contact with the nip forming member 22 through the grooves 43.

On the other hand, the second plate 41 has the U-shape and is formed of a stainless plate having a thickness less than that of the first plate 29. Similar to the first plate 29, the second plate 41 has the grooves 43 so that the protruding parts 23*a* of the holding member 23 are in contact with the nip forming member 22 through the grooves 43. The second plate 41 is provided so as to cover the nip forming member 22 with the inner peripheral surface of the fixing sleeve 21 when the nip forming member 22 is in contact with the fixing sleeve 21. To that end, the heights of a downstream side surface section 41*a* and a upstream side surface section 41*b* of the second plate 41 are less than the height of the nip forming member 22 when the nip forming member 22 is engaged with the U shape of the second plate 41 by moving the nip forming member 22 in the arrow C direction of FIG. 8, so that the upper surface of the nip forming member 22 can be in contact with the fixing sleeve 21.

Both the first plate 29 and the second plate 41 have bolt holes, so that the first plate 29 and the second plate 41 can be fixed by bolts. Further, the first plate 29 includes plate protruding parts 29*a* extending in the axis direction of the fixing sleeve 21, so that the plate protruding parts 29*a* can be engaged with the grooves formed on the respective flanges 35 (see FIG. 4). As a result, the first plate 29 and the second plate 41 are fixed to the fixing device 20 via the flanges 35.

Further, the nip forming member 22 is provided so as to be engaged with the U shape of the second plate 41. Therefore, the nip forming member 22 is also fixed to the fixing device 20 via the second plate 41, the first plate 29, and the flanges 35.

As illustrated in FIG. 4, the flange 35 includes a first flange part 35*a* and a second flange part 35*f*. The first flange part 35*a* is provided to be in slide contact with the inner peripheral surface of the fixing sleeve 21 at both ends of the fixing sleeve 21. The second flange part 35*f* is provided to determine the position of the fixing sleeve 21 in the axis direction by being in slide contact with the edge part of the fixing sleeve 21.

Further, the flange 35 has an opening part 35*d* that contains the end section of the holding member 23. Further, the flange 35 includes a groove 35*e* that can fix the position of the holding member 23. The groove 35*e* is provided to prevent the holding member 23 being rotated in the circumferential direction. As a result, the holding member 23 can stably hold the nip forming member 22. Further, the flange 35 has another groove (not shown) to prevent the movement of the holding member 23 in the axis direction.

Further, the flange 35 has an opening part 35*b*, so that the plate protruding parts 29*a* of the first plate 29 and an end part 22*b* (see FIG. 8) of the nip forming member 22 can be inserted into the opening part 35*b*. Further, the flange 35 includes a protrusion 35*c* protruding in the opening part 35*b*. The protrusion 35*c* is provided to be engaged with a U-shaped groove 22*c* (see FIG. 7) formed in the end part 22*b* of the nip forming member 22. As a result, the first plate 29 and the nip forming member 22 are fixed to the apparatus 1, when the fixing device 20 is assembled.

As illustrated in FIG. 5, the first flange part 35*a* of the flange 35 is provided so as to maintain the shape of the fixing sleeve 21 by being in slide contact with the inner peripheral surface of the fixing sleeve 21 at both ends (edge parts) of the fixing sleeve 21. Further, the first flange part 35*a* has an arc shape on the upstream side of the fixing nip section 38. The radius of the arc shape is substantially the same as the radius of the fixing sleeve 21. In FIG. 5, the arc axis of the arc is expressed by 35*g*. In this case, the area of the upper half may be decreased as long as the area can contain the holding member 23 and the like. Therefore, in this embodiment, the first flange part 35*a* is formed in a manner such that the cross-sectional area of the lower half is greater than the cross-sectional area of the upper half.

Further, the first flange part 35*a* includes not a round surface part but a flat surface part 35*h* in the upper half area above the arc axis 35*g*. By having the flat surface part 35*h*, it may become possible to increase the size of he area of the lower half of the arc axis 35*g* even the circumferential length of the fixing sleeve 21 is unchanged. Further, since the first flange part 35*a* includes the flat surface part 35*h*, it may become possible to separate the fixing sleeve 21 from the first flange part 35*a* on the down stream side of the fixing nip section 38. As a result, it may become possible to reduce the amount of heat transferred from the fixing sleeve 21 to the first flange part 35*a*.

In this case, the flanges 35 are disposed on both ends of the fixing sleeve 21 and maintain the shape of the fixing sleeve 21 by being in direct and indirect slide contact with the inner peripheral surface of the fixing sleeve 21. Therefore, the flanges 35 may be referred to as a shape maintaining unit of the present invention.

As illustrated in FIG. 5, the outline of the outer shape line of the flange 35 may be a shape formed by combining plural arc shapes. Further, a part of the fixing sleeve 21 is involved in the fixing nip section 38. From this point of view, the flange 35 may have a different shape other than a round shape in response to the circumferential length of the fixing sleeve 21. The shape of the fixing sleeve 21 becomes a shape corresponding to the outer shape of the flange 35.

In FIG. 5, a case is described where the halogen heater is used. On the other hand, FIG. 12 illustrates the case where the sheet heating element 53 is used.

As illustrated in FIG. 6, the inner peripheral surface 21*a* of the fixing sleeve 21 includes the area where the fixing sleeve 21 is not in slide contact with the flange 35. To improve the slidability and the heat conductivity from the sheet heating element 53 to the fixing sleeve 21 in the area to be in slide contact with the sheet heating element 53, coating is performed on the area. By the coating, it may become possible to effectively transfer the heat from the sheet heating element 53 to the surface of the fixing sleeve 21 in the center area of the fixing sleeve 21 in the longitudinal (axis) direction of the fixing sleeve 21 (i.e., in the area corresponding to the area of the fixing nip section 38 where unfixed toner is to be permanently fixed). Further, it may become possible to reduce the abrasion over time. The area painted (coated) in black in the fixing device of the first embodiment corresponds to the area where coating is performed in the fixing device of this embodiment. Therefore, the repeated description of the area with reference to FIG. 6 is herein omitted.

On the other hand, coating may be performed on the areas (hatched area in FIG. 6) which correspond to both end section (edge parts) of the inner peripheral surface 21*a* of the fixing sleeve 21 and where the fixing sleeve 21 is in slide contact with the first flange part 35*a*. For example, the coating includes fluorochemical coating such as PFA coating and PTFA coating. By coating in this way, it may become possible to reduce the sliding resistance of the fixing sleeve 21 to the flange 35. Especially, the fixing sleeve 21 is rotated in accordance with the rotation of the pressing roller 31. Because of this feature, when the sliding resistance of the fixing sleeve 21 to the flange 35 is increased, the rotating shape of the fixing sleeve 21 may be accordingly changed. From the point of view, by coating as described above, it may become possible to reduce the change of the rotating shape of the fixing sleeve 21 and maintain stable rotation of the fixing sleeve 21. In the description above, a case is described where the coating is performed on the parts of the fixing sleeve 21. However, the present invention is not limited to this configuration. For example, grease may alternatively be applied.

Further, in the above description, a case is described where the coating is performed on the end sections (edge parts) of the fixing sleeve 21 and the center area of the fixing sleeve 21. In this case, for example, different materials having different characteristics may be separately coated on the areas. Further, a coating material having a low friction coefficient may be coated (applied) to the entire inner peripheral surface of the fixing sleeve 21. In this case, it may become possible to improve the efficiency of the heat transfer and reduce the sliding resistance at the same time. Further, the processing cost of the fixing device 20 may also be reduced.

As described above, according to this embodiment, it may become possible to reduce the sliding resistance of the fixing sleeve 21 and the energy consumption of the driving motor (not shown) to rotate the fixing sleeve 21 via the pressing roller 31. As a result, the energy consumption in the fixing device according to this embodiment may be reduced when compared with a fixing device in the related art. Further, it may become possible to reduce the slippage of the fixing sleeve 21 relative to the pressing roller 31, the slippage being caused by higher sliding resistance.

In FIG. 12, there are depicted two horizontal (dashed-dotted) lines. The horizontal (dashed-dotted) line passing the point 31*a* in the pressing roller 31 is herein called the first central axis line X. On the other hand, the horizontal (dashed-dotted) line passing the point 35*g* in the fixing sleeve 21 is herein called the second central axis line Y. In this embodiment, those two lines (X and Y) are not superimposed in the same line (i.e., those two lines are separated from each other). Actually, the second central axis line Y of the fixing sleeve 21 is disposed on the upstream side of the fixing nip section 38 relative to the first central axis line X of the pressing roller 31 by a distance D. The symbol D in FIG. 12 denotes the displacement of the central axis.

Herein, the pressing roller 31 has a central axis 31*a* which corresponds to the rotation center of the pressing roller 31. The first central axis line X is the line passing through the central axis 31*a* and extending in the cross-sectional direction of the pressing roller 31 and in the direction orthogonal to the feeding direction of the recording medium P.

On the other hand, as described above, the flange 35 has its arc axis 35*g*. The second central axis line Y is the line passing through the arc axis 35*g* and extending in the cross-sectional direction of the flange 35 and in the direction orthogonal to the feeding direction of the recording medium P. In this embodiment, the arc axis 35*g* refers to the center of the arc having a fixed curvature R and formed as a part of the first flange part 35*a* on the upstream side of the fixing nip section 38. When the first flange part 35*a* does not have an arc having a fixed curvature R, the position of 35*g* may be defined as the center of the maximum line among the lines within (i.e., between the upper and lower parts of) the first flange part 35*a* and extending in the direction parallel to the feed direction of the recording medium P.

Therefore, the first central axis line X connecting between (passing through) the central axis 31*a* of the pressing roller and a substantial center 31*b* of the fixing nip section 38 is separated from the second central axis line Y connecting between (passing through) the arc axis 35*g* and a point 35*i* where the arc of the first flange part 35*a* is terminated on the side opposite to the side of the fixing nip section 38 by the distance D.

To that end, the sheet heating element 53 is disposed on the upstream side of the first central axis line X in the feeding direction, and the holding member 23 is disposed on the downstream side of the second central axis line Y in the feeding direction.

As described above, the shape of the fixing sleeve 21 may be maintained based on the shape of the first flange parts 35*a* of the flanges 35. Namely, various shapes of the fixing sleeve 21 may be formed based on the shapes of the first flange parts 35*a* of the flanges 35. Because of this feature, it may become possible to dispose the heat source in a more appropriate position when compared with the related art. Further, it may become possible to reduce the circumferential length of the fixing sleeve 21. As a result, the size of the fixing device may be reduced.

Furthermore, the nip forming member 22 is eccentrically disposed on the upper side in the fixing sleeve 21 (see FIG. 12). Therefore, it may become possible to increase the space for disposing the sheet heating element 53 on the upstream side of the fixing nip section 38. Accordingly, the number of the sheet heating element 53 (heat sources) to be disposed may be increased from one to two or more than two. When plural heaters can be disposed, for example the plural heaters may be arranged in the axis direction of the fixing sleeve 21. As a result, it may become possible to heat the fixing sleeve 21 more accurately. In the example of FIG. 12, a case is described where two heaters (the sheet heating elements 53A and 53B) are disposed. However, the number of the heaters may be one or more than two.

Next, operations of the fixing device 20 are described with reference to FIG. 12.

First, when receiving an output signal from the image forming apparatus 1 (e.g., when a user operates an operation panel or a personal computer and transmits a print request to the image forming apparatus), in the fixing device 20, a pressing and depressing member (not shown) drives the pressing roller 31, so that the pressing roller 31 presses the nip forming member 22 via the fixing sleeve 21 to form the fixing nip section 38.

Next, when the pressing roller 31 is rotated in the clockwise direction (i.e., the arrow B direction) of FIG. 2 by a driving device (not shown), the fixing sleeve 21 is rotated in the counterclockwise direction (i.e., the arrow A direction) of FIG. 12. In this case, due to the positional relationship between the fixing nip section 38 and the flange 35, tension is applied to the fixing sleeve 21 in a predetermined area (in the case of FIG. 12, the lower side of the second central axis line Y). Therefore, the fixing sleeve 21 is able to be in slide contact with the nip forming member 22 at the upper side area of the fixing nip section 38.

Upon the operation of the driving device, power is supplied to the sheet heating element 53 from an external power supply or an internal electric storage device. Then, heat is effectively transferred in the circumferential direction and in the entire width direction of the fixing sleeve 21 by the sheet heating element 53, so that the fixing sleeve 21 is rapidly heated. However, it is not always necessary to start the operation of the driving device and the heating by the sheet heating element 53 at the same time. An appropriate time shift may be applied to start separately.

In this case, heat is controlled by the sheet heating element 53 so that the temperature of the fixing nip section 38 is substantially equal to a predetermined temperature by using the temperature sensor 27 which is or is not in contact with the fixing sleeve 21. When the temperature is increased to the necessary (predetermined) temperature, the temperature is controlled to be maintained, and the introduction of the recording medium P into the fixing nip section 38 is started.

As described above, in the fixing device 20 in this embodiment, the heat capacity of the fixing sleeve 21 and the sheet heating element 53 is relatively small. Therefore, it may become possible to reduce the warm-up time and the first printing time while reducing the energy consumption.

Normally, when no output signal is transmitted to the image forming apparatus, to reduce the power consumption, the rotation of the pressing roller 31 and the fixing sleeve 31 is stopped and the power applied to the sheet heating element 53 is also stopped. However, in this embodiment, when it is necessary to output (restart) instantly, it may be possible to supply power to the sheet heating element 53 while stopping the rotation of the pressing roller 31 and the fixing sleeve 31. In this case, the power may be supplied to the sheet heating element 53 so that the temperature of the entire fixing sleeve 21 can be maintained.

As described above, in the fixing device according to this embodiment, it may become possible to increase the space on the upstream side of the holding member 23 (nip forming member 22) and on the inner periphery side of the fixing sleeve 21. Because of this feature, it may become possible to dispose the heat source at desirable positions and reduce the circumferential length of the fixing sleeve 21. Therefore, the size of the fixing device 20 according to this embodiment may be reduced when compared with the fixing device of the related art. As a result, the power consumption of the fixing device 20 according to this embodiment may also be reduced when compared with the fixing device of the related art.

Further, due to the flange 35, the fixing sleeve 21 may rotationally slide along the first flange part 35*a* of the flange 35. As a result, the shape (cylindrical shape) of the fixing sleeve 21 may be maintained.

Further, in the fixing device of this embodiment, the sheet heating element 53 is used as the heating unit. Further, the sheet heating element 53 is provided to be in direct contact with the fixing sleeve 21 to directly transfer heat to the fixing sleeve 21. Therefore, it may become possible to effectively heat the fixing sleeve 21.

Further, in the fixing device of this embodiment, coating is performed on the inner peripheral surface of the fixing sleeve 21. Therefore, it may become possible to reduce the sliding resistance between the sheet heating element and the fixing sleeve and improve the efficiency of the thermal conductivity. As a result, it may become possible to effectively control the temperature to be a predetermined temperature.

Further, in the fixing device of this embodiment, the sheet heating element includes the first sheet heating element 53A and the second sheet heating element 53B. The first sheet heating element 53A heats the center region in the longitudinal direction of the fixing sleeve 21. The second sheet heating element 53B heats the respective end regions (parts) in the axis direction of the fixing sleeve 21. Further, the sensor 27 includes the first temperature sensor 27A and the second temperature sensors 27B. The first temperature sensor 27A is disposed at the position corresponding to the position where the first sheet heating element 53A radiates heat most. In the same manner, the second temperature sensors 27B are disposed at positions corresponding to the positions where the second sheet heating element 53B radiates heat most. Because of this feature, it may become possible to accurately detect the temperatures of the heat generating portions.

According to an embodiment of the present invention, a fixing device includes a rotating fixing member formed of a flexible material and made in a form of an endless belt, a pressing member disposed on an outer periphery side of the fixing member and pressing the fixing member; a contacting member disposed on an inner periphery side of the fixing member and being in contact with the pressing member via the fixing member upon being pressed by the pressing member; a holding member disposed on the inner periphery side of the fixing member and holding the contacting member in a pressing direction of the pressing member; a heating unit heating the fixing member; and shape maintaining units disposed on respective ends (edge parts) of the fixing member and maintaining a shape of the fixing member by being in direct or indirect slide contact with an inner peripheral surface of the fixing member. Further, when a first central axis line is a line passing through a center axis of the pressing member and extending in a direction orthogonal to a feeding direction of a recording medium passing through the fixing device on a vertical cross section of the fixing device and a second central axis line is a line passing through an arc axis of the shape maintaining units and extending in the direction orthogonal to the feeding direction of on the vertical cross section of the fixing device, the heating unit is disposed on an upstream side of the first central axis line in the feeding direction and the holding member is disposed on a downstream side of the second central axis line in the feeding direction.

By having this configuration, it may become possible to increase the space on the upper stream side of the contacting member on the inner periphery side of the fixing member. As a result, it may become possible to dispose the heat sources at their desirable positions and it may become possible to reduce the circumferential length of the fixing member. Therefore, it may become possible to reduce the energy consumption of the entire fixing device. Further, by having the configuration, it may become possible to slidably rotate the fixing member by covering the ends (edges) of the fixing member with the shape maintaining units. Further, it may become possible to determine the form of the cylindrical shape of the fixing member based on the shape of the shape maintaining units.

Further, the heating unit may be a halogen heater radiating heat.

By having this configuration, it may become possible to directly heat the fixing member using the radiation heat from the halogen heater.

The fixing device may further include a rotation supporting member disposed on the inner periphery side of the fixing member, having a pipe-like shape, and supporting a rotation of the fixing member.

By having this configuration, it may become possible to rotatably support the fixing member and maintain the shape of the fixing member. As a result, it may become possible to reduce the deflection of the fixing member.

Further, the color of the inner peripheral surface of the fixing member is substantially black.

By doing this, it may become possible to improve the absorption rate of the radiation heat. As a result, it may become possible to set the desired temperature more efficiently.

Further, the heating unit may include a sheet heating element which is a sheet-like heat generating member in slide contact with the fixing member, a press support member pressing the sheet heating element to the fixing member, and a biasing member biasing the press support member so that the sheet heating element can be in close contact with the fixing member.

By having this configuration, it may become possible to reduce the space inside the fixing member, increase the heat efficiency, and effectively heat the heating member when compared with the case where the halogen heater is used to directly heat the fixing member by the radiation heat. Further, the sheet heating element and the press support member are in contact with the fixing member. Therefore, it may become possible to maintain the shape of the fixing member while the fixing member is rotated. As a result, the fixing member may be stably rotated.

Further, the heating unit may include a center section heating unit heating a center section of the fixing member in an axis direction of the fixing member, end section heating units heating respective end sections of the fixing member in the axis direction, a center section temperature detecting unit detecting a temperature of the center section heating unit, and end section heating units detecting temperatures of the respective end section heating units. Further, the center section temperature detecting unit and the end section heating units are disposed at positions corresponding to the positions where the center section heating unit and the end section heating units, respectively, generate heat most.

By having this configuration in which temperatures are detected at the positions where the respective heat sources generate heat most, it may become possible to accurately detect the temperatures of the heating units.

Further, coating may be performed on parts of the fixing member, the parts being where the fixing member is in slide contact with the shape maintaining units.

In this configuration, the fixing member rotates relative to the shape maintaining units. Therefore, the sliding resistance may be reduced, and therefore the energy consumption of the driving motor to rotate the fixing member via the pressing member may be reduced. As a result, when compared with the fixing device of the related art, it may become possible to reduce the energy consumption of the entire fixing device and the slippage of the fixing member relative to the pressing member, the slippage occurring due to greater sliding resistance.

Further, coating may be performed on a part of the fixing member, the part being where the fixing member is in slide contact with the sheet heating element.

By doing this, it may become possible to reduce the friction resistance caused by sliding between the inner peripheral surface of the fixing member and the surface of the sheet heating member. Therefore, it may become possible to reduce the abrasion over time. As a result, it may become possible to provide a fixing device having higher durability when compared with the fixing device of the related art.

According to an embodiment of the present invention, an image forming apparatus includes the fixing device described above.

By configuring in this way, since the size of the fixing device may be reduced when compared with the fixing device of the related art, the energy consumption of the entire image forming apparatus may be reduced and the warm-up time may be reduced. As a result, it may become possible to provide an image forming apparatus having higher usability.

According to an embodiment of the present invention, it may become possible to reduce the sizes and the energy consumption of the fixing device and the image forming apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

a fixing member formed of a flexible material, made in a form of an endless belt, and configured to rotate;

a pressing member disposed on an outer periphery side of the fixing member and configured to press the fixing member;

a contacting member disposed on an inner periphery side of the fixing member and configured to be in contact with the pressing member via the fixing member upon being pressed by the pressing member;

a holding member disposed on the inner periphery side of the fixing member and configured to hold the contacting member in a pressing direction of the pressing member;

a heating unit configured to heat the fixing member; and supports disposed at respective ends of the fixing member to maintain a shape of the fixing member by being in direct or indirect slide contact with an inner peripheral surface of the fixing member, wherein a first central axis line passes through a center axis of the pressing member and extends in a direction orthogonal to a feeding direction of a recording medium passing through the fixing device, and a second central axis line passes through an arc axis of the supports and extends in the direction orthogonal to the feeding direction, wherein the heating unit is at least disposed on an upstream side of the first central axis line in the feeding direction and the holding member is disposed on a downstream side of the second central axis line in the feeding direction, wherein each of the supports includes a flange having a first half area that is on an upstream side in the feeding direction relative to the arc axis, the first half area is greater than a second half area of the flange that is on a downstream side in the feeding direction relative to the arc axis;

wherein the holding member is contained in the second half area of the flange.

2. The fixing device according to claim 1, wherein the heating unit is a halogen heater radiating heat.

3. The fixing device according to claim 1, further comprising:

a rotation supporting member disposed on the inner periphery side of the fixing member, having a pipe-like shape, and configured to support a rotation of the fixing member.

4. The fixing device according to claim 1, wherein a color of the inner peripheral surface of the fixing member is substantially black.

5. The fixing device according to claim 1, wherein the heating unit includes:

a sheet heating element which is a sheet-like heat generating member and is configured to be in slide contact with the fixing member, a press support member configured to press the sheet heating element to the fixing member, and a biasing member configured to bias the press support member so that the sheet heating element can be in close contact with the fixing member.

6. The fixing device according to claim 1, wherein the heating unit includes:

a center section heating unit configured to heat a center section of the fixing member in an axis direction of the fixing member, end section heating units configured to heat respective end sections of the fixing member in the axis direction, a center section temperature detecting unit configured to detect a temperature of the center section heating unit, and end section temperature detecting units configured to detect temperatures of the respective end section heating units, and wherein the center section temperature detecting unit and the end section temperature detecting units are disposed at positions corresponding to the positions where the center section heating unit and the end section heating units, respectively, generate heat most.

7. The fixing device according to claim 1, wherein a coating is applied on parts of the fixing member, the parts being where the fixing member is in slide contact with the supports.

8. The fixing device according to claim 5, wherein a coating is applied on a part of the fixing member, the part being where the fixing member is in slide contact with the sheet heating element.

9. An image forming apparatus comprising:

the fixing device according to claim 1.

10. The fixing device according to claim 1, wherein each of the supports includes a groove that receives an end section of the holding member and fixes the position of the holding member.

11. The fixing device according to claim 1, wherein each flange includes a first flange in direct or indirect slide contact with an inner peripheral surface of a respective end of the fixing member, each first flange including a curved surface that transitions to a flat surface part that is located on a downstream side of the first central axis line in the feeding direction.

12. The fixing device according to claim 1, wherein the second central axis line connects between the arc axis and a point where an arc of the flange is terminated on an upstream side of a fixing nip section in the feeding direction.

13. The fixing device according to claim 11, wherein at least a portion of each flat surface part does not contact the inner peripheral surface of the respective end of the fixing member.

14. A fixing device comprising:

a fixing member formed of a flexible material, made in a form of an endless belt, and configured to rotate;

a pressing member disposed on an outer periphery side of the fixing member and configured to press the fixing member;

a contacting member disposed on an inner periphery side of the fixing member and configured to be in contact with the pressing member via the fixing member upon being pressed by the pressing member;

a holding member disposed on the inner periphery side of the fixing member and configured to hold the contacting member in a pressing direction of the pressing member;

a heating unit configured to heat the fixing member; and supports disposed at respective ends of the fixing member to maintain a shape of the fixing member by being in direct or indirect slide contact with an inner peripheral surface of the fixing member, wherein a first central axis line passes through a center axis of the pressing member and extends in a direction orthogonal to a feeding direction of a recording medium passing through the fixing device, and a second central axis line passes through an arc axis of the supports and extends in the direction orthogonal to the feeding direction, wherein the heating unit is at least disposed on an upstream side of the first central axis line in the feeding direction and the holding member is disposed on a downstream side of the second central axis line in the feeding direction, wherein each of the supports includes a first flange in direct or indirect slide contact with an inner peripheral surface of a respective end of the fixing member, each first flange including a curved surface that transitions to a flat surface part that is located on a downstream side of the first central axis line in the feeding direction, wherein each of the supports includes a second flange extending radially outward from a respective first flange, each second flange includes an opening with a first protrusion extending radially inward, wherein each end of the contacting member includes a first groove and extends through the opening of a respective second flange, and wherein each first protrusion is located in the first groove of a respective end of the contacting member.

15. The fixing device according to claim 14, further comprising a first plate formed with a U-shaped cross-section and a protruding part at each end of the first plate, wherein the contacting member fits within the U-shaped cross-section of the first plate, and wherein the first plate is located between the contacting member and the pressing member on the inner periphery side of the fixing member.

16. The fixing device of according to claim 15, wherein each protruding part of the first plate extends through the opening of the respective second flange.

17. The fixing device according to claim 15, wherein the holding member includes a plurality of second protrusions that extend into respective grooves formed in the first plate and contact respective second protrusions formed on a side of the contacting member opposite to a side that contacts the inner peripheral surface of the fixing member.

18. A fixing device comprising:

a fixing member formed of a flexible material, made in a form of an endless belt, and configured to rotate;

a pressing member disposed on an outer periphery side of the fixing member and configured to press the fixing member;

a contacting member disposed on an inner periphery side of the fixing member and configured to be in contact with the pressing member via the fixing member upon being pressed by the pressing member;

a holding member disposed on the inner periphery side of the fixing member and configured to hold the contacting member in a pressing direction of the pressing member;

a heating unit that is a halogen heater radiating heat and configured to heat the fixing member; and supports disposed at respective ends of the fixing member to maintain a shape of the fixing member by being in direct or indirect slide contact with an inner peripheral surface of the fixing member, wherein a first central axis line passes through a center axis of the pressing member and extends in a direction orthogonal to a feeding direction of a recording medium passing through the fixing device, and a second central axis line passes through an arc axis of the supports and extends in the direction orthogonal to the feeding direction, wherein the heating unit is at least disposed on an upstream side of the first central axis line in the feeding direction and the holding member is disposed on a downstream side of the second central axis line in the feeding direction, and wherein each of the supports includes a first flange in direct or indirect slide contact with an inner peripheral surface of a respective end of the fixing member, each first flange including a curved surface that transitions to a flat surface part that is located on a downstream side of the first central axis line in the feeding direction.

* * * * *